US010005588B2

(12) United States Patent
Kanbar et al.

(10) Patent No.: US 10,005,588 B2
(45) Date of Patent: Jun. 26, 2018

(54) CASE FOR TOBACCO PRODUCTS

(71) Applicant: Maurice S. Kanbar Revocable Trust, San Francisco, CA (US)

(72) Inventors: Maurice S. Kanbar, San Francisco, CA (US); Albert Kolvites, San Mateo, CA (US)

(73) Assignee: Maurice S. Kanbar Revocable Trust, San Francisco, CA (US)

( * ) Notice: Subject to any disclaimer, the term of this patent is extended or adjusted under 35 U.S.C. 154(b) by 0 days. days.

(21) Appl. No.: 15/358,706

(22) Filed: Nov. 22, 2016

(65) Prior Publication Data

US 2018/0141714 A1 May 24, 2018

(51) Int. Cl.

| | |
|---|---|
| ***B65D 25/04*** | (2006.01) |
| ***B65D 43/16*** | (2006.01) |
| ***B65D 85/10*** | (2006.01) |
| ***A24F 15/12*** | (2006.01) |

(52) U.S. Cl.

CPC ..... *B65D 25/04* (2013.01); *A24F 15/12* (2013.01); *B65D 43/162* (2013.01); *B65D 85/10* (2013.01)

(58) Field of Classification Search

CPC ..... B65D 25/04; B65D 43/162; B65D 85/10; A24F 15/12

USPC ..... 220/524, 523, 538, 256

See application file for complete search history.

(56) References Cited

U.S. PATENT DOCUMENTS

| | | | |
|---|---|---|---|
| 64,826 | A | 5/1867 | Appel |
| 242,632 | A | 6/1881 | Gruner |
| 486,004 | A | 11/1892 | Ullin |
| 522,881 | A | 7/1894 | Cronenwett |
| 666,781 | A | 1/1901 | Urick |

(Continued)

FOREIGN PATENT DOCUMENTS

| | | | |
|---|---|---|---|
| GB | 2169263 | A | 7/1986 |

OTHER PUBLICATIONS

Partial European Search Report for EP 17202760.9 dated Feb. 26, 2018, 15 pages.

*Primary Examiner* — Chun Cheung

(74) *Attorney, Agent, or Firm* — Drinker Biddle & Reath LLP

(57) ABSTRACT

A case for storing tobacco products comprises body having a cavity formed therein. A divider traverses the cavity and defines a boundary between first and second compartments within the cavity. A first lid is pivotally coupled to the body by a first hinge, and a second lid is pivotally coupled to the body by a second hinge. The first lid can be detachably coupled to the divider so as to enclose the first compartment, and the second lid can be detachably coupled to the divider so as to enclose the second compartment. Preferably, the divider is offset from the medial centerline of the body, so that the first compartment has the same length and depth, but a smaller width, than the second compartment. Thus, the case may be configured such that a single tobacco product can be stored in the first compartment, and multiple tobacco products of the same type can be stored in the second compartment. The first and second compartments are sufficiently sealed when the lids are in the closed position that a burning tobacco product stored in either compartment will be quickly extinguished due to a lack of oxygen when the lid for that compartment is moved to the closed position.

20 Claims, 29 Drawing Sheets

(56) References Cited

U.S. PATENT DOCUMENTS 687,664 A * 11/1901 Smith ..... B65D 85/32 220/508
1,221,398 A 4/1917 White
2,619,092 A 11/1952 Ayers
4,465,184 A 8/1984 Bruce
4,819,666 A 4/1989 Turver
4,897,033 A 1/1990 Yang
5,447,673 A 9/1995 Belvederi
5,605,226 A 2/1997 Hernlein
5,806,670 A * 9/1998 Harlan ..... A61J 1/03 116/67 R
5,934,894 A 8/1999 Cigler
5,996,783 A 12/1999 Herchelroth
6,364,100 B1 4/2002 Leibeck
6,736,261 B1 5/2004 Thomas et al.
6,761,266 B2 * 7/2004 Popish ..... A45C 11/16 206/38
7,014,039 B2 3/2006 Henson et al.
7,748,554 B2 * 7/2010 Murphy ..... B65D 21/0204 206/538
8,091,557 B2 1/2012 Cortesi
8,146,627 B2 * 4/2012 Mazur ..... A61J 1/03 141/240
8,490,784 B2 7/2013 Cortesi
8,602,210 B2 12/2013 Milner et al.
9,205,950 B2 * 12/2015 Roesler ..... B65D 21/0204
2004/0089581 A1 * 5/2004 Dienst ..... B65D 43/22 206/538
2004/0108080 A1 6/2004 Nien
2004/0256253 A1 12/2004 Henson et al.
2005/0173272 A1 8/2005 Lemmons
2007/0228047 A1 * 10/2007 Pehr ..... B65D 51/18 220/524
2010/0116825 A1 5/2010 Young
2012/0031780 A1 2/2012 Milner et al.
2012/0285846 A1 11/2012 Cortesi
2014/0262884 A1 * 9/2014 Priebe ..... A61J 1/03 206/365
2015/0257980 A1 * 9/2015 Fung ..... A61J 1/03 700/242

* cited by examiner

CASE FOR TOBACCO PRODUCTS

TECHNICAL FIELD

The present invention relates to cases for tobacco products, and more particularly to a case having a body with a cavity formed therein and a divider partitioning the cavity into first and second compartments, each of which can be enclosed by a separate lid that is pivotally coupled to the body.

BACKGROUND

Standard paperboard containers in which tobacco products are typically sold provide an economical packaging solution, but they suffer from a number of shortcomings. In particular, they are easily damaged and therefore may not have sufficient structural strength to protect the tobacco products stored therein. Moreover, they do not provide a safe and convenient means for storing a partially consumed tobacco product. Several existing cases for tobacco products attempt to address these shortcomings. For example, U.S. Pat. No. 242,632, to Gruner, discloses a cigar holder that is designed to hold a burning cigar by providing a non-conducting lining or jacket that covers the entire interior of a pair of retaining shells that are hinged together. The lining allegedly prevents the passage of heat through the holder when a lighted cigar is deposited therein. U.S. Pat. No. 522,881, to Cronenwett, similarly discloses a case having two halves that are connected to each other by hinges. A lining extends from an extreme end of the case to an intermediate point, at which point the lining in each half is thickened. When the case is closed around a partially consumed cigar, the cigar is held in place by the thickened portion of the liner, with the moistened tip of the cigar extending into the unlined portion of the case, thus being held out of contact with any burning ashes. U.S. Pat. No. 1,221,398, to White, discloses a cigar case having two members that are hinged together by bearing members having a pintle extending therethrough. The case includes a resilient finger that is arranged such that a cigar can be slipped under the finger, thereby holding the cigar against movement within the case.

Some existing cases attempt to improve upon the above-mentioned designs by additionally providing a mechanism for cutting off the burning end of the partially consumed tobacco product. U.S. Pat. No. 64,826, to Appel, discloses a case consisting of two semi-cylindrical shells that are hinged together at one side. A cutter is secured to the front edge of one of the shells such that when the shells are closed, the cutter can be used to cut off the point of a cigar. U.S. Pat. No. 486,004, to Ullin, discloses a cigar case constructed of two longitudinal hollow or concave portions, that are hinged together along one edge. A shallow traverse knife or cutter having a concave shape on its cutting edge is secured a short distance from one end of one of the portions of the case, and a transverse knife or cutter having a convex shape is secured to the other portion, such that when the two portions are shut together, the convex cutter will close down past the concave cutter, thereby making a clean cut of the burning end of the cigar and depositing it forward of the cutters, with the unburned portion of the cigar being left back of the cutters. U.S. Pat. No. 666,781, to Ulrick, similarly discloses a cigar case having upper and lower sections that are connected by hinges. A disk-shaped cutter is secured along one end of the upper section, and the lower section is entirely open at that end, having a lip formed at the open end. The lip of the lower section provides a receiving groove for the sharp semi-circular edge of the cutter of the upper section when the two sections are brought together. Thus, when the two sections are closed around a partially consumed cigar, the cutter severs the lighted projecting end of the cigar, enclosing the unconsumed portion within the case and permitting the severed lighted portion to fall to the ground. While the cases disclosed by Gruner, Cronenwett, White, Appel, Ullin, and Ulrick, are purportedly designed to store a partially consumed tobacco product, they all suffer from the shortcoming that they can store only a single tobacco product.

Some cases attempt to further improve upon the above-mentioned designs by providing for the storage of multiple tobacco products. U.S. Pat. No. 5,996,783, to Herchelroth, discloses a case having opposing housing segments that are hinged together. Each segment includes a recess, which cooperate with each other to define a chamber that is dimensioned to receive one or more cigars or cigarettes. A fiberglass liner unit conforms to the interior of the chamber, preventing heat from a burning cigar from being conducted to the surface of the housing. U.S. Pat. No. 5,934,894, to Cigler, discloses an apparatus for storing rolled tobacco products having a lighter section, a rolled tobacco products section, and a refuse section. The lighter section is designed to accommodate a lighter, and the rolled tobacco products section includes a cavity that can be sized to store a single rolled tobacco product, or alternatively can be sized to store multiple rolled tobacco products. The refuse section includes a clipping aperture bounded on at least one side by a sharp edge, and a cutting door having a sharp cutting blade can be moved by use of a finger actuator so as to close the clipping aperture in such a manner that the cutting blade abuts the sharp edge, thereby shearing and cutting any tobacco product inserted within the clipping aperture. While the cases disclosed by Herchelroth and Cigler can store multiple tobacco products, they do not have separate compartments, one for storing partially consumed tobacco products, and another for storing fresh tobacco products.

U.S. Pat. No. 2,619,092, to Ayers, also discloses a cigarette case that can store multiple tobacco products. The cigarette case disclosed by Ayers includes a combined extinguisher and ashtray. The case is a box-like structure including a lid that is pivotally attached to a rear wall by a hinge, and a front door wall comprising a moveable upper section and a stationary lower section that are pivotally attached to each other by a hinge. A number of semi-cylindrical cavities are rigidly attached to the rear wall, and a corresponding number of abutting semi-cylindrical cavities are rigidly attached to the upper section of the front door wall, such that the cavities register with each other when the front door wall is closed, thereby forming a series of abutting parallel tubes having an inside diameter approximately equal to that of an average cigarette. In operation, the burning end of a cigarette is inserted into one of the tubular openings formed by the cavities and is pushed completely into the tube, and the lid is closed. The cigarette is purportedly extinguished almost instantly upon its compete insertion into the tube, and its ashes drop into a receptacle formed at the bottom of the case. The unburned cigarette can be removed by first opening the lid, and then opening the moveable upper section of the front door wall. While the case disclosed by Ayers provides an advantage over the previously-described cases in that it allows a partially smoked tobacco product to be stored in a separate tube from fresh tobacco products, it does not prevent the fresh tobacco products from coming into contact with the burning ashes of a partially smoked tobacco product, since all of the tubes are open at their lower ends to the same receptacle at the bottom of the case.

Some existing cases provide multiple compartments, each of which can store one or more tobacco products. U.S. Pat. No. 4,819,666, to Turver, discloses a cigarette container having a cap threaded to a main body, a long central opening within the main body for receiving the full length of a cigarette, and a cup portion covered by a serrated ash holder at the lower end of the long central opening. The serrated ash holder rides on the spiral threads of a threaded lining member, which is connected to a knob. When the knob is turned clockwise, the ash holder rises on the spiral threads to meet the head of a cigarette inserted into the opening, causing the cigarette filter to protrude from the opening so that it can be easily removed. When the cigarette has been partially smoked, it can be reinserted into the opening, thereby extinguishing the lit end by both pressure against the ash holder and by lack of oxygen. The process is repeated each time the user wants to smoke the cigarette. Turver discloses that extra tubes may be added to the side of the container to store additional cigarettes, but Turver does not disclose any details regarding the configuration of any such extra tubes.

U.S. Pat. No. 8,490,784, to Cortesi, discloses an article for smokers comprising a main body having a first service housing, a cavity, and a second service housing. The first service housing, which can be used to store a lighter or a cigarette or cigar, is externally accessible at the first end of the main body. The second service housing, which can receive a whole or cut cigarette or alternatively a spare lighter, can be made externally accessible by moving a part that is translatably coupled to the second end of the main body. The cavity is formed in the part at the second end of the main body that covers the second service housing. This part includes a cutting element that can be moved from an open position in which the lit end of a cigarette can be introduced into the cavity, to a closed position in which the cutting element detaches the lit portion of the cigarette. The detached lit portion is then hermetically sealed within the cavity. While Cortesi states that the second service housing is covered by the part at the second end of the main body, Cortesi does not disclose any structure for covering the first service housing.

U.S. Pat. No. 5,605,226, to Hernlein, discloses a smoker's convenience caddy for lighting a cigarette, depositing ashes, and holding a cigarette while it is not being smoked. The caddy includes a body and a lid, which are attached to each other by a bungee cord. One pocket provides for the deposit of ashes, and another provides for the storage of a lighter unit. Hernlein discloses that the pocket for storing ashes can alternatively be used to store a partially smoked cigarette, and the pocked for storing a lighter unit can alternatively be used to store fresh cigarettes. Both pockets, however, are covered by the single lid, and the bungee cord may not provide a reliable and secure means of attaching the lid to the body.

Accordingly, there remains a need for an improved case for tobacco products.

SUMMARY

One embodiment of the present invention is directed to a case for storing tobacco products comprising a body having a cavity formed therein, a divider, and first and second lids. The body may comprise an inner surface defining an interior boundary of the body and delimiting the cavity, an outer surface defining an exterior boundary of the body, and a lip defining an upper boundary of the body and circumscribing an open upper end of the cavity. The lip of the body may be demarcated by upper edges of the inner and outer surfaces of the body. The divider may traverse the cavity and define a partition between first and second compartments within the cavity. The first lid may comprise an inner surface, an outer surface, and a rim demarcated by peripheral edges of the inner and outer surfaces of the first lid. Similarly, the second lid may comprise an inner surface, an outer surface, and a rim demarcated by peripheral edges of the inner and outer surfaces of the second lid.

The case may include means for pivotally coupling the first lid to the body such that the first lid can pivot back and forth from an open position, in which the first compartment is accessible through the lip of the body, to a closed position, in which the first compartment is enclosed by the body, the divider, and the first lid. The inner surface of the first lid may contact the lip of the body when the first lid is in the closed position. The case may also include means for detachably coupling the first lid to the divider when the first lid is in the closed position.

Similarly, the case may include means for pivotally coupling the second lid to the body such that the second lid can pivot back and forth from an open position, in which the second compartment is accessible through the lip of the body, to a closed position, in which the second compartment is enclosed by the body, the divider, and the second lid. The inner surface of the second lid may contact the lip of the body when the second lid is in the closed position. The case may also include means for detachably coupling the second lid to the divider when the second lid is in the closed position.

The divider may have a slot formed therein. The divider may comprise a first wall having a first surface partially delimiting the slot, a second surface partially delimiting the first compartment, and a lip defining an upper boundary of the first wall. The lip of the first wall may be demarcated by upper edges of the first and second surfaces of the first wall. The divider may also comprise a second wall having a first surface partially delimiting the slot, a second surface partially delimiting the second compartment, and a lip defining an upper boundary of the second wall. The lip of the second wall may be demarcated by upper edges of the first and second surfaces of the second wall.

The means for detachably coupling the first lid to the divider may comprise a first arm extending outward from the inner surface of the first lid. The first arm may comprise first and second surfaces defining opposite sides of the first arm. Similarly, the means for detachably coupling the second lid to the divider comprise a second arm extending outward from the inner surface of the second lid. The second arm may comprise first and second surfaces defining opposite sides of the second arm. The case may be configured such that the first arm is received within the slot and the first surface of the first arm is positioned flush against the first surface of the first wall to achieve an interference fit between the first arm and the divider when the first lid is in the closed position, and such that the first arm vacates the slot when the first lid is in the open position. Likewise, the case may be configured such that the second arm is received within the slot and the first surface of the second arm is positioned flush against the first surface of the second wall to achieve an interference fit between the second arm and the divider when the second lid is in the closed position, and such that the second arm vacates the slot when the second lid is in the open position.

The first and second surfaces of the first and second walls may each comprise a planar lateral portion. The planar lateral portions of the first and second surfaces of the first and second walls may be parallel to one another. The inner surface of the body may comprise first and second planar lateral portions that are parallel to each other and to the planar lateral portions of the first and second surfaces of the first and second walls. The first planar lateral portion of the inner surface of the body may partially delimit the first compartment, and the second planar lateral portion of the inner surface of the body may partially delimit the second compartment. The inner surface of the body may also comprise planar anterior and posterior portions that are parallel to each other, and that are perpendicular to the first and second planar lateral portions of the inner surface of the body and to the planar lateral portions of the first and second surfaces of the first and second walls. Anterior ends of the first and second walls may be coupled to the planar anterior portion of the inner surface of the body, and posterior ends of the first and second walls may be coupled to the planar posterior portion of the inner surface of the body. Additionally, the inner surface of the body may also comprise a planar lower portion that is perpendicular to the first and second planar lateral portions, planar anterior portion, and planar posterior portion of the inner surface of the body, and to the planar lateral portions of the first and second surfaces of the first and second walls. Lower ends of the first and second walls may be coupled to the planar lower portion of the body.

The first wall may have a recess formed therein. The lip of the first wall may comprise anterior and posterior portions that are contiguous and coplanar with the lip of the body. The inner surface of the first lid may contact the anterior and posterior portions of the lip of the first wall when the first lid is in the closed position. The first wall may also comprise an intermediate portion extending downward between the anterior and posterior portions of the lip of the first wall and delimiting the recess formed in the first wall.

Similarly, the second wall may have a recess formed therein. The lip of the second wall may comprise anterior and posterior portions that are contiguous and coplanar with the lip of the body. The inner surface of the second lid may contact the anterior and posterior portions of the lip of the second wall when the second lid is in the closed position. The second wall may also include an intermediate portion extending downward between the anterior and posterior portions of the lip of the second wall and delimiting the recess formed in the second wall.

The rim of the first lid may comprise proximal and distal portions, which may be parallel to each other. The case may be configured such that the distal portion of the rim of the first lid rotates around the proximal portion of the rim of the first lid when the first lid pivots back and forth from the open position to the closed position. Similarly, the rim of the second lid may comprise proximal and distal portions, which may be parallel to each other. The case may be configured such that the distal portion of the rim of the second lid rotates around the proximal portion of the rim of the second lid when the second lid pivots back and forth from the open position to the closed position.

The inner surfaces of the first and second lids may each comprise a planar portion. A proximal end of the first arm may be coupled to the planar portion of the inner surface of the first lid, and a proximal end of the second arm may be coupled to the planar portion of the inner surface of the second lid. The first and second surfaces of the first arm may each comprise a planar portion. The planar portions of the first and second surfaces of the first arm may be parallel to each other and to the proximal and distal portions of the rim of the first lid, and may be perpendicular to the planar portion of the inner surface of the first lid. Likewise, the first and second surfaces of the second arm may each comprise a planar portion. The planar portions of the first and second surfaces of the second arm may be parallel to each other and to the proximal and distal portions of the rim of the second lid, and may be perpendicular to the planar portion of the inner surface of the second lid. Distal edges of the planar portions of the first and second surfaces of the first arm may be parallel to the planar portion of the inner surface of the first lid, and may be coupled to each other by a bevel or a chamfer. Similarly, distal edges of the planar portions of the first and second surfaces of the second arm may be parallel to the planar portion of the inner surface of the second lid, and may be coupled to each other by a bevel or a chamfer.

The means for detachably coupling the first lid to the divider may comprise a first overhang formed on the divider. Likewise, means for detachably coupling the second lid to the divider comprises a second overhang formed on the divider. The case being configured such that the first overhang engages the distal portion of the rim of the first lid to achieve a snap fit between the first lid and the divider when the first lid is in the closed position, and such that the first overhang disengages the distal portion of the rim of the first lid when the first lid is in the open position. Similarly, the case may be configured such that the second overhang engages the distal portion of the rim of the second lid to achieve a snap fit between the second lid and the divider when the second lid is in the closed position, and such that the second overhang disengages the distal portion of the rim of the second lid when the second lid is in the open position.

The lip of the first wall may comprise anterior and posterior portions that are demarcated by upper edges of the first and second surfaces of the first wall and are contiguous and coplanar with the lip of the body. The inner surface of the first lid may contact the anterior and posterior portions of the lip of the first wall when the first lid is in the closed position. Similarly, the lip of the second wall may comprise anterior and posterior portions that are demarcated by upper edges of the first and second surfaces of the second wall and are contiguous and coplanar with the lip of the body. The inner surface of the second lid may contact the anterior and posterior portions of the lip of the second wall when the second lid is in the closed position.

The means for detachably coupling the first lid to the divider may further comprise a first projection extending upward from the first wall between the anterior and posterior portions of the lip of the first wall. The means for detachably coupling the second lid to the divider may further comprise a second projection extending upward from the second wall between the anterior and posterior portions of the lip of the second wall.

The first and second projections may each comprise a planar upper surface. The first overhang may comprise a first planar retraction surface extending between the upper edge of the second surface of the first wall and a projecting edge of the planar upper surface of the first projection. The first planar retraction surface and the planar lateral portion of the second surface of the first wall may intersect at a first obtuse refraction angle. Similarly, the second overhang may comprise a second planar retraction surface extending between the upper edge of the second surface of the second wall and a projecting edge of the planar upper surface of the second projection. The second planar retraction surface and the planar lateral portion of the second surface of the second wall may intersect at a second obtuse refraction angle.

The first lid may have a recess formed therein. In such a configuration, the distal portion of the rim of the first lid may comprise anterior and posterior portions that are coplanar with each other, and that are parallel with the proximal portion of the rim of the first lid. The distal portion of the rim may also comprise an intermediate portion extending laterally inward between the anterior and posterior portions of the distal portion of the rim of the first lid and delimiting the recess formed in the first lid. The intermediate portion of the distal portion of the rim of the first lid may comprise a bevel or a chamfer. Similarly, the second lid may have a recess formed therein. In such a configuration, the distal portion of the rim of the second lid may comprise anterior and posterior portions that are coplanar with each other, and that are parallel with the proximal portion of the rim of the second lid. This distal portion of the rim may also comprise an intermediate portion extending laterally inward between the anterior and posterior portions of the distal portion of the rim of the second lid and delimiting the recess formed in the second lid. The intermediate portion of the distal portion of the rim of the second lid may comprise a bevel or a chamfer.

The case may be configured such that the planar upper surface of the first projection is coplanar with the outer surface of the first lid, and the bevel or chamfer of the rim of the first lid is positioned flush against the first planar retraction surface, when the first lid is in the closed position. The case may also be configured such that the planar upper surface of the second projection is coplanar with the outer surface of the second lid, and the bevel or chamfer of the rim of the second lid is positioned flush against the second planar retraction surface, when the second lid is in the closed position.

The first lid may further comprise a semi-cylindrical projection extending outward from a distal end of the inner surface of the first lid along the bevel or chamfer of the first lid, and the second lid may further comprise a semi-cylindrical projection extending outward from a distal end of the inner surface of the second lid along the bevel or chamfer of the second lid.

The divider may be offset from a centerline of the cavity, such that the first compartment is smaller than the second compartment, and such that the first lid is smaller than the second lid.

The outer surface of the body may comprise first and second planar lateral portions that are parallel to each other. The outer surface of the body may further comprise planar anterior and posterior portions that are parallel to each other, and that are perpendicular to the first and second planar lateral portions of the outer surface of the bod. Additionally, the outer surface of the body may further comprise a planar lower portion that is perpendicular to the first and second planar lateral portions, the planar anterior portion, and the planar posterior portion of the outer surface of the body.

The means for pivotally coupling the first lid to the body may comprise a first living hinge coupling the proximal portion of the rim of the first lid to an upper end of the first planar lateral portion of the outer surface of the body. Likewise, the means for pivotally coupling the second lid to the body may comprise a second living hinge coupling the proximal portion of the rim of the second lid to an upper end of the second planar lateral portion of the outer surface of the body.

The case may further comprise a metal cap having first and second lateral portions, a posterior portion, and a lower portion. The metal cap may affixed within the first compartment such that the first lateral portion, the posterior portion, and the lower portion of the metal cap are coupled to the inner surface of the body, and the second lateral portion of the metal cap is coupled to the divider. Additionally, the case may further comprise a metal lid coupled to the inner surface of the first lid so as to face the lower portion of the metal cap when the first lid is in the closed position.

The rim of the first lid may comprise an anterior portion having a principal portion that is coplanar with the outer surface of the body, and a projecting portion formed at a distal end of the anterior portion of the rim of the first lid. The projecting portion of the anterior portion of the rim of the first lid may extend outward from the principal portion of the anterior portion of the rim of the first lid so as to overhang the outer surface of the body. The rim of the first lid may further comprise a posterior portion having a principal portion that is coplanar with the outer surface of the body, and a projecting portion formed at a distal end of the posterior portion of the rim of the first lid. The projecting portion of the posterior portion of the first lid may extend outward from the principal portion of the posterior portion of the rim of the first lid so as to overhang the outer surface of the body Similarly, the rim of the second lid may comprise an anterior portion having a principal portion that is coplanar with the outer surface of the body, and a projecting portion formed at a distal end of the anterior portion of the rim of the second lid. The projecting portion of the anterior portion of the rim of the second lid may extend outward from the principal portion of the anterior portion of the rim of the second lid so as to overhang the outer surface of the body. The rim of the second lid may further comprise a posterior portion comprising a principal portion that is coplanar with the outer surface of the body, and a projecting portion formed at a distal end of the posterior portion of the rim of the second lid. The projecting portion of the posterior portion of the second lid may extend outward from the principal portion of the posterior portion of the rim of the second lid so as to overhang the outer surface of the body.

The outer surface of the first lid may comprise a principal portion and an elevated portion formed at a distal end of the outer surface of the first lid. The elevated portion may extend upward from the principal portion of the outer surface of the first lid. Similarly, the outer surface of the second lid may comprise a principal portion and an elevated portion formed at a distal end of the outer surface of the second lid. The elevated portion may extend upward from the principal portion of the outer surface of the second lid.

The elevated portion of the outer surface of the first lid may have a different texture than the principal portion of the outer surface of the first lid, and the elevated portion of the outer surface of the second lid may have a different texture than the principal portion of the outer surface of the second lid. Additionally or alternatively, the elevated portion of the outer surface of the first lid may have a different color than the principal portion of the outer surface of the first lid, and the elevated portion of the outer surface of the second lid may have a different color than the principal portion of the outer surface of the second lid.

The inner surface of the second lid may comprise a planar peripheral portion that contacts the lip of the body when the lid is in the closed position, and a planar central portion that projects outward from, and is parallel to, the peripheral portion of the inner surface of the first lid.

BRIEF DESCRIPTION OF THE DRAWINGS

Various embodiments of the invention are described in the following detailed description with reference to the accompanying drawings, in which.

DETAILED DESCRIPTION

A case for tobacco products and its method of manufacture and use are described herein. The specific details set forth in the following description provide an understanding of certain embodiments of the invention, and do not limit the scope of the invention as set forth in the claims. Certain structures and steps that are well known in the art are not described in detail. Reference is made in the following description to the accompanying drawings. Wherever possible, the same reference numbers are used throughout the drawings and the corresponding description to refer to the same or similar structures or steps.

Figure 1:
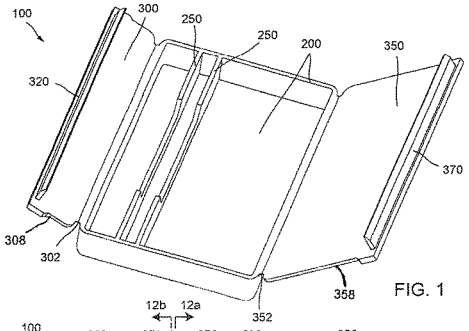
FIG. 1 is a perspective view of a case for storing tobacco products in accordance with one embodiment of the present invention with first and second lids open.
Figure 2:
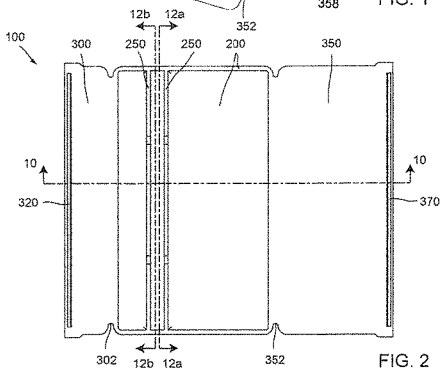
FIG. 2 is a top view of the case of FIG. 1 with first and second lids open.
Figure 3:
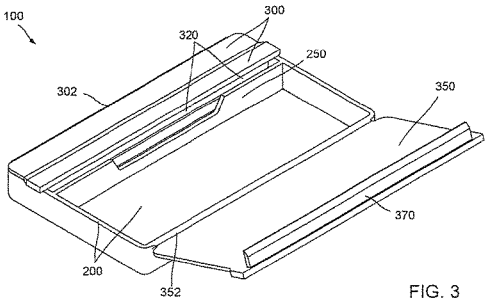
FIG. 3 is a perspective view of the case of FIG. 1 with a first lid closed and a second lid open.
Figure 4:
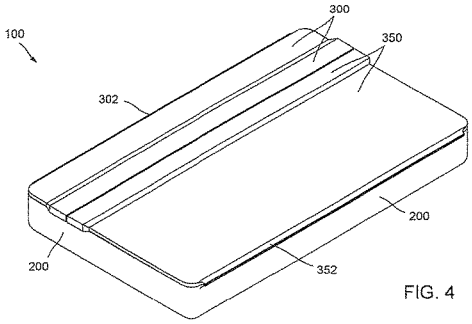
FIG. 4 is a perspective view of the case of FIG. 1 with first and second lids closed.
Figure 6:
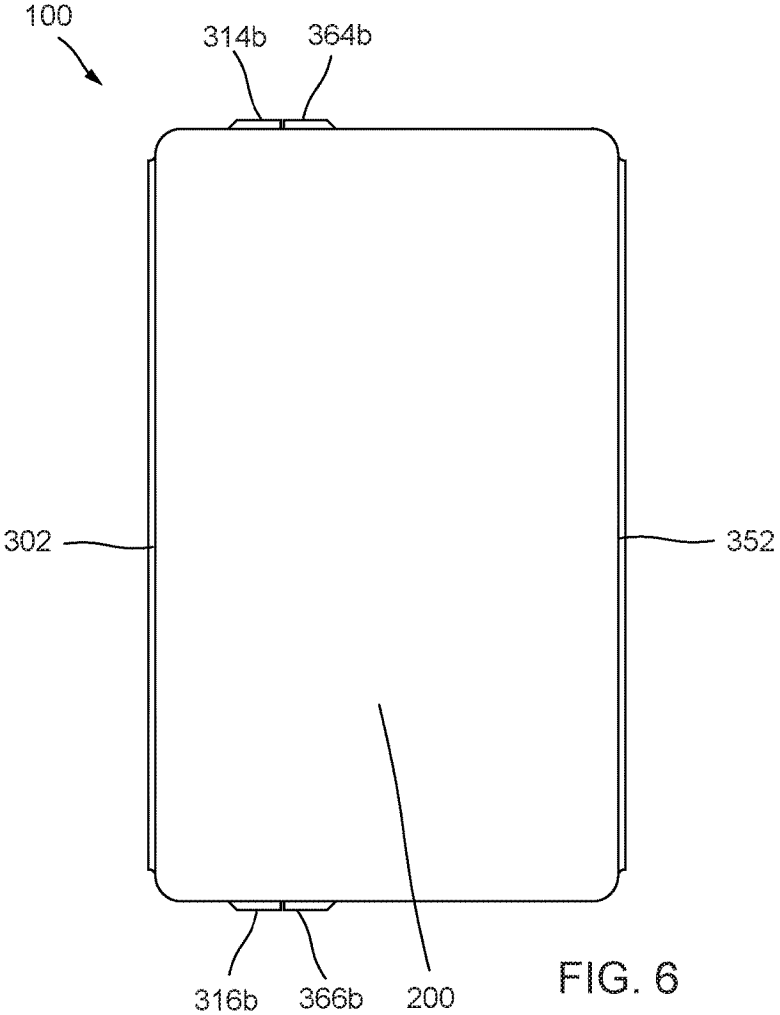
FIG. 6 is a bottom view of the case of FIG. 1 with first and second lids closed.
Figure 5:
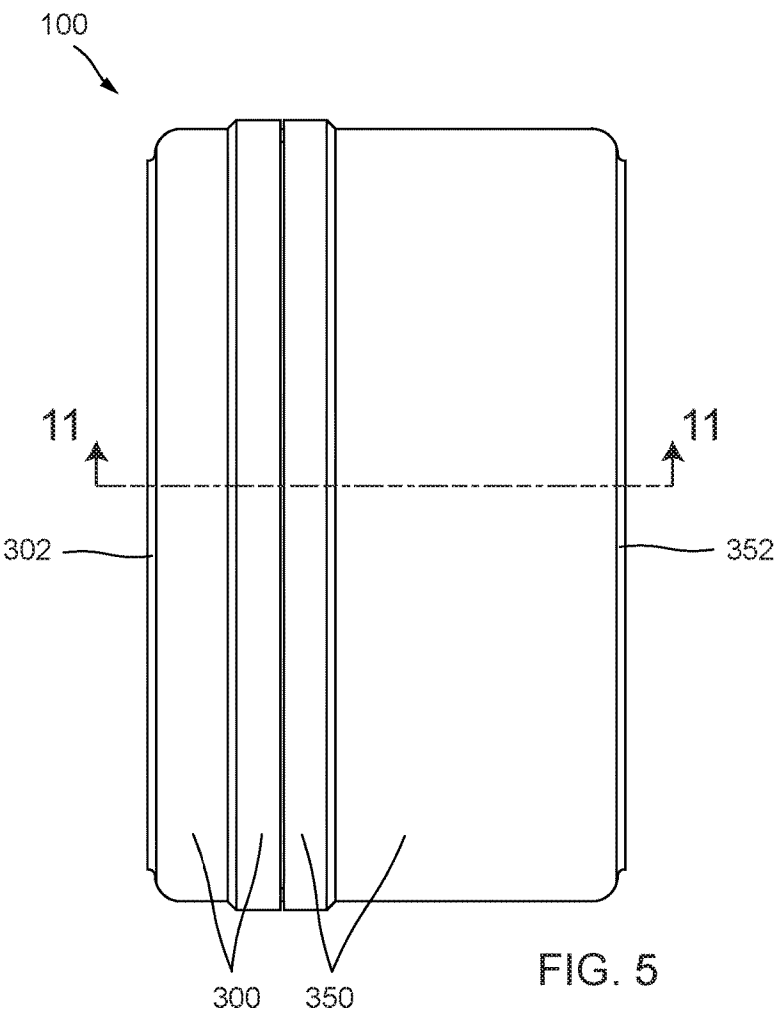
FIG. 5 is a top view of the case of FIG. 1 with first and second lids closed.
Figure 7:
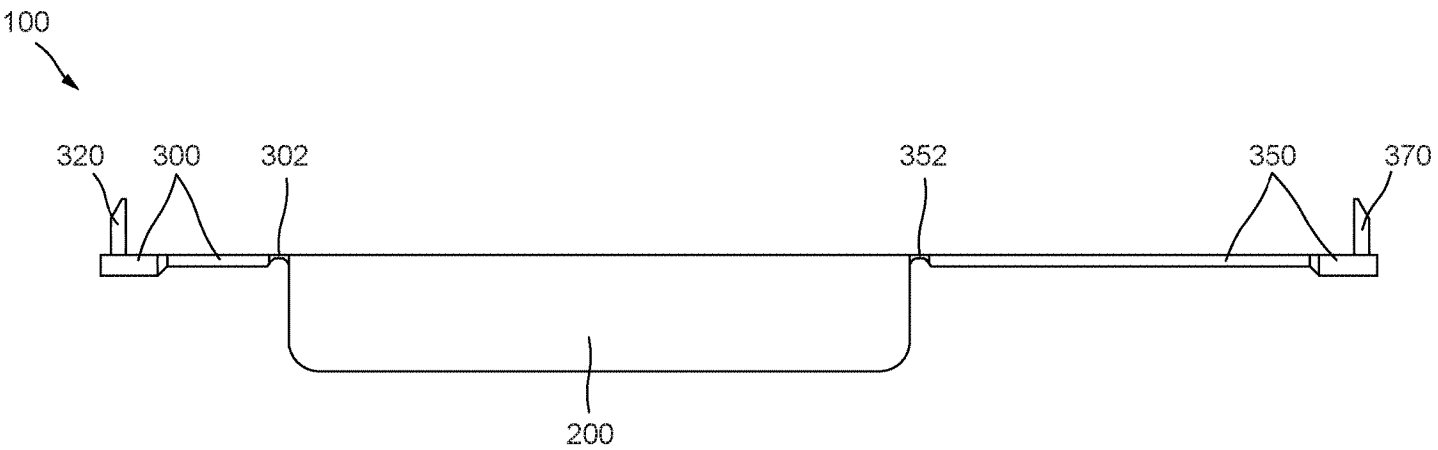
FIG. 7 is an end view of the case of FIG. 1 with first and second lids open.
Figure 8:
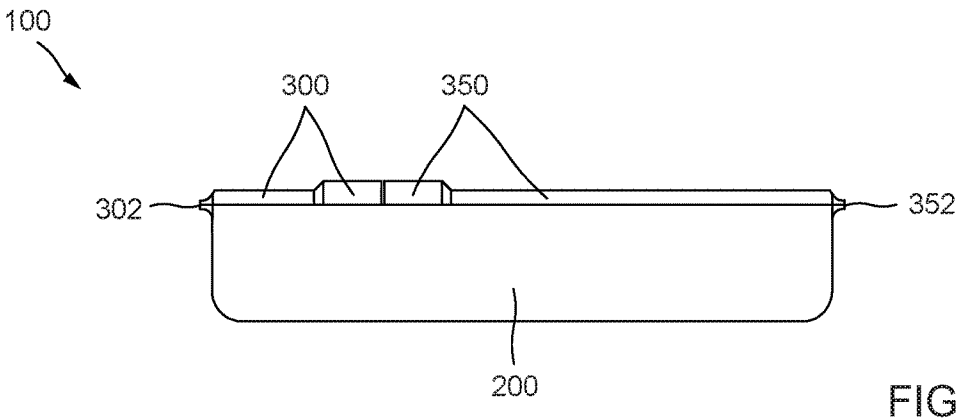
FIG. 8 is an end view of the case of FIG. 1 with first and second lids closed.
Figure 9A:
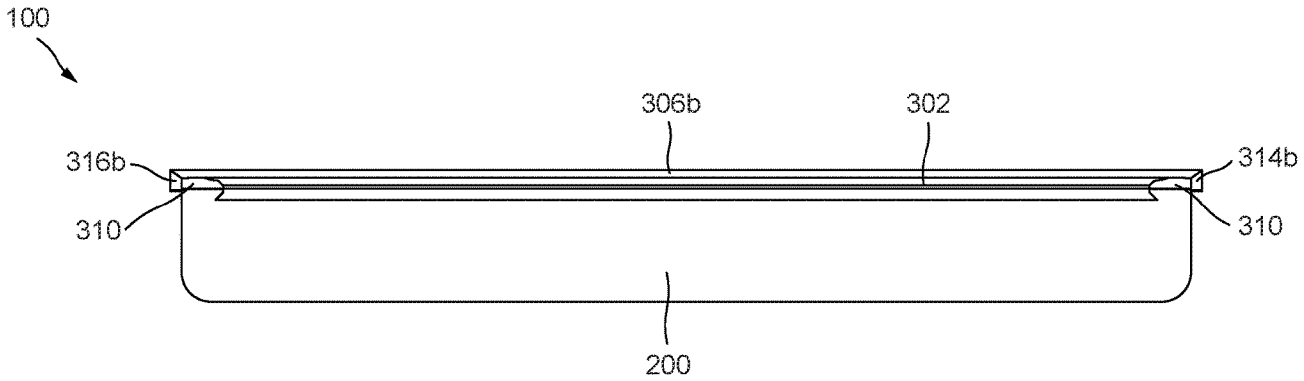
FIGS. 9*a* and 9*b* are side views of the case of FIG. 1 with first and second lids closed.
Figure 9B:
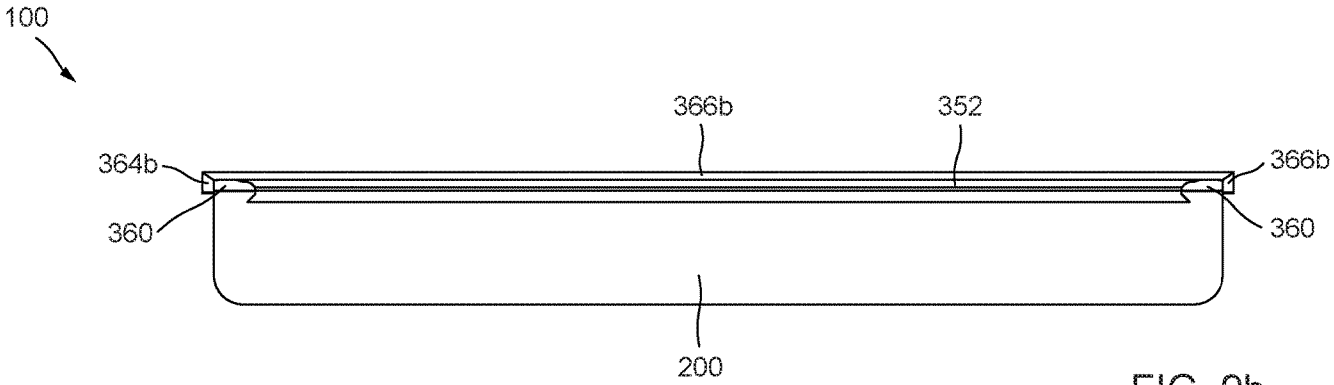
Figure 10:
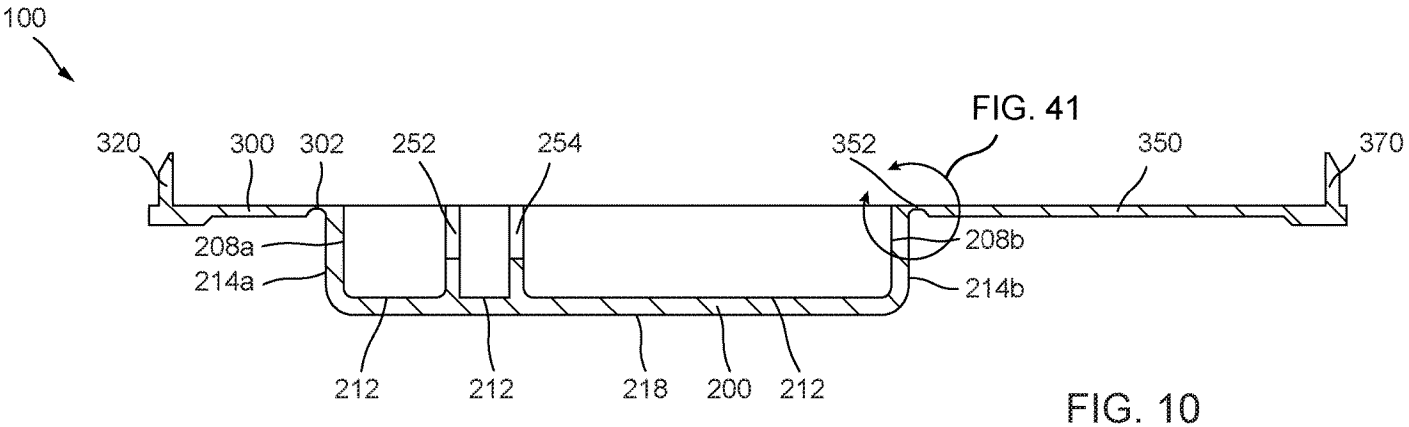
FIG. 10 is a cross-sectional view through a vertical plane showing the interior of the case of FIG. 1 with first and second lids open.
Figure 11:
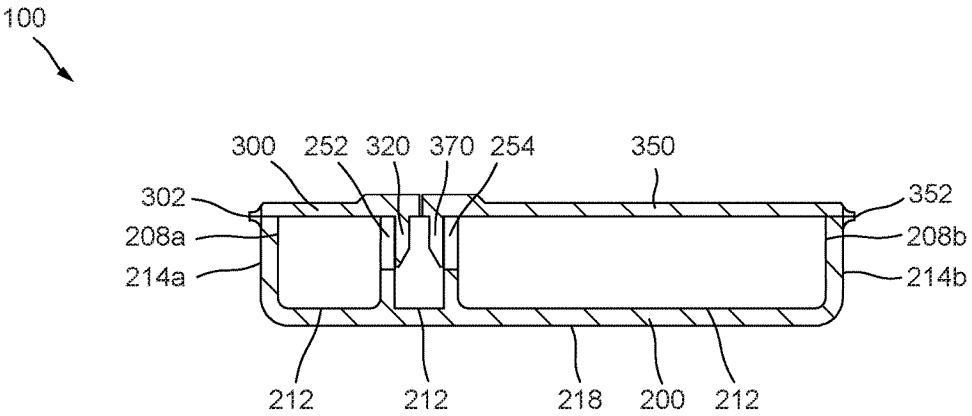
FIG. 11 is a cross-sectional view through a vertical plane showing the interior of the case of FIG. 1 with first and second lids closed.
Figure 12A:
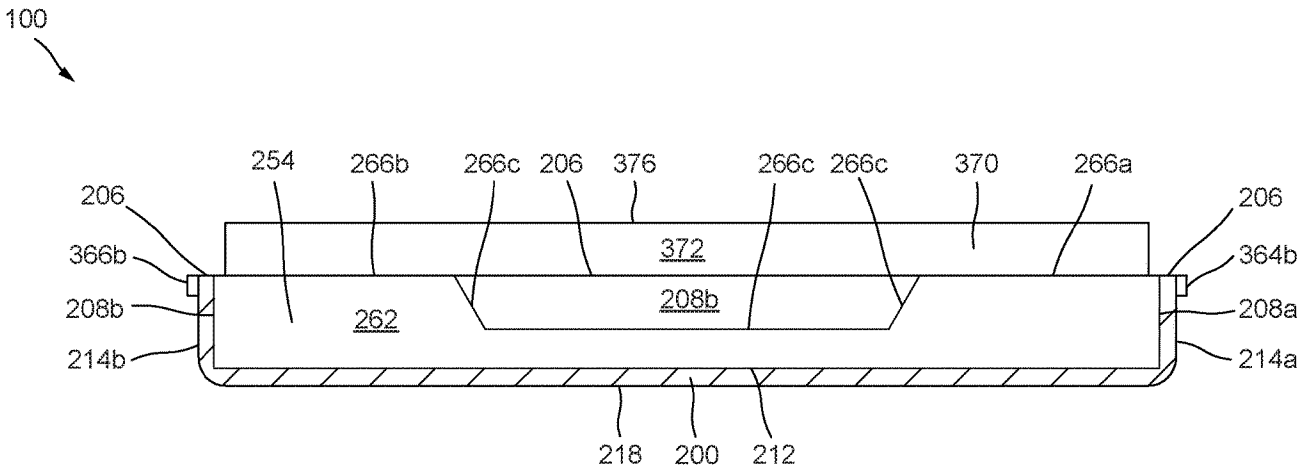
FIGS. 12*a* and 12*b* are cross-sectional views through a vertical plane showing the interior of the case of FIG. 1 with first and second lids open.
Figure 12B:
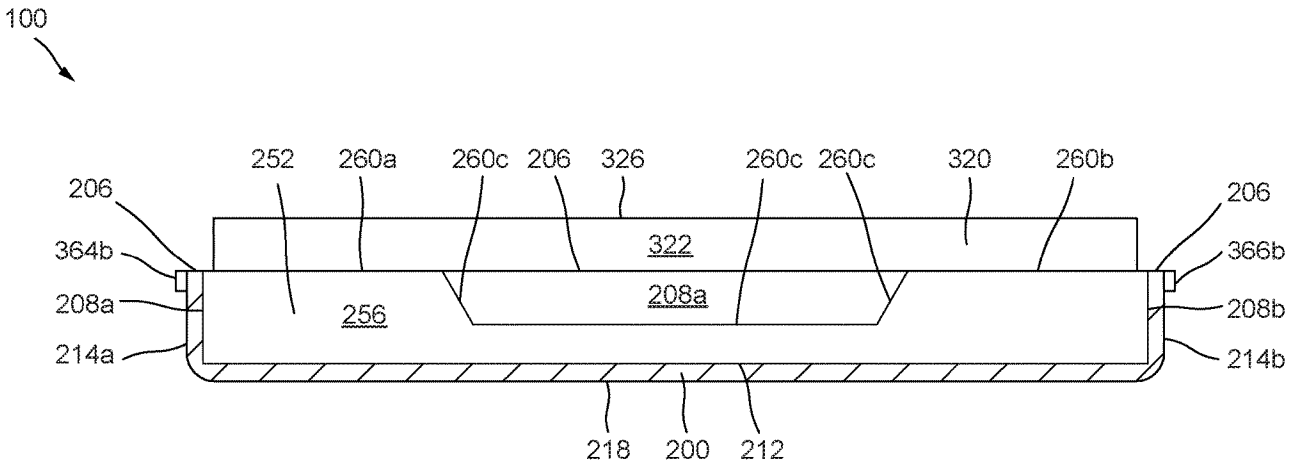
Figure 13:
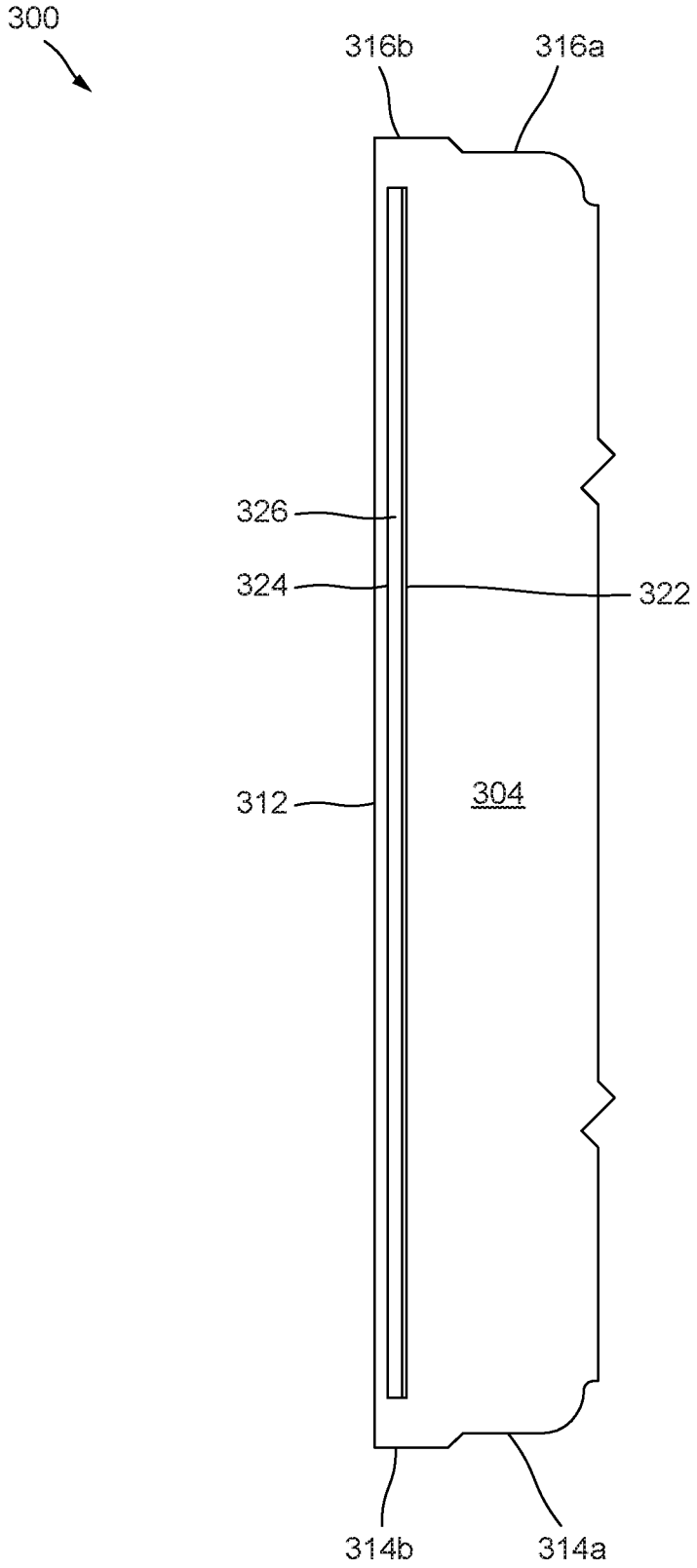
FIG. 13 is a top view of a first lid of the case of FIG. 1.
Figure 14:
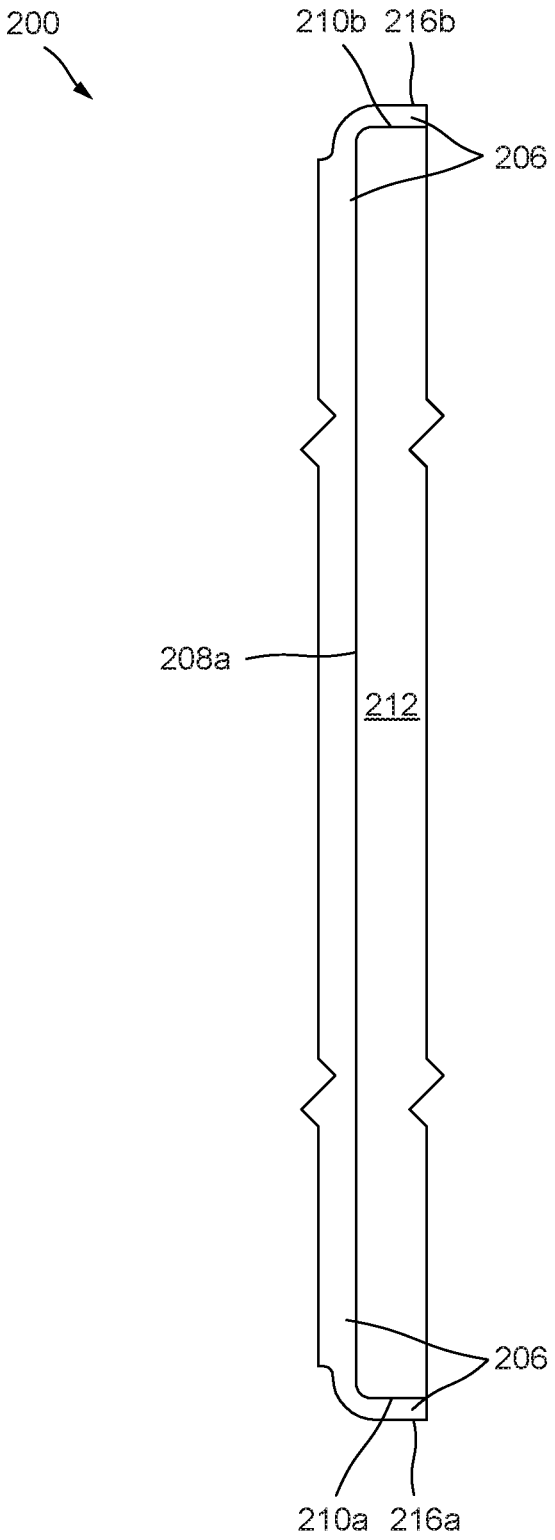
FIG. 14 is a top view of a portion of a body of the case of FIG. 1.
Figure 15:
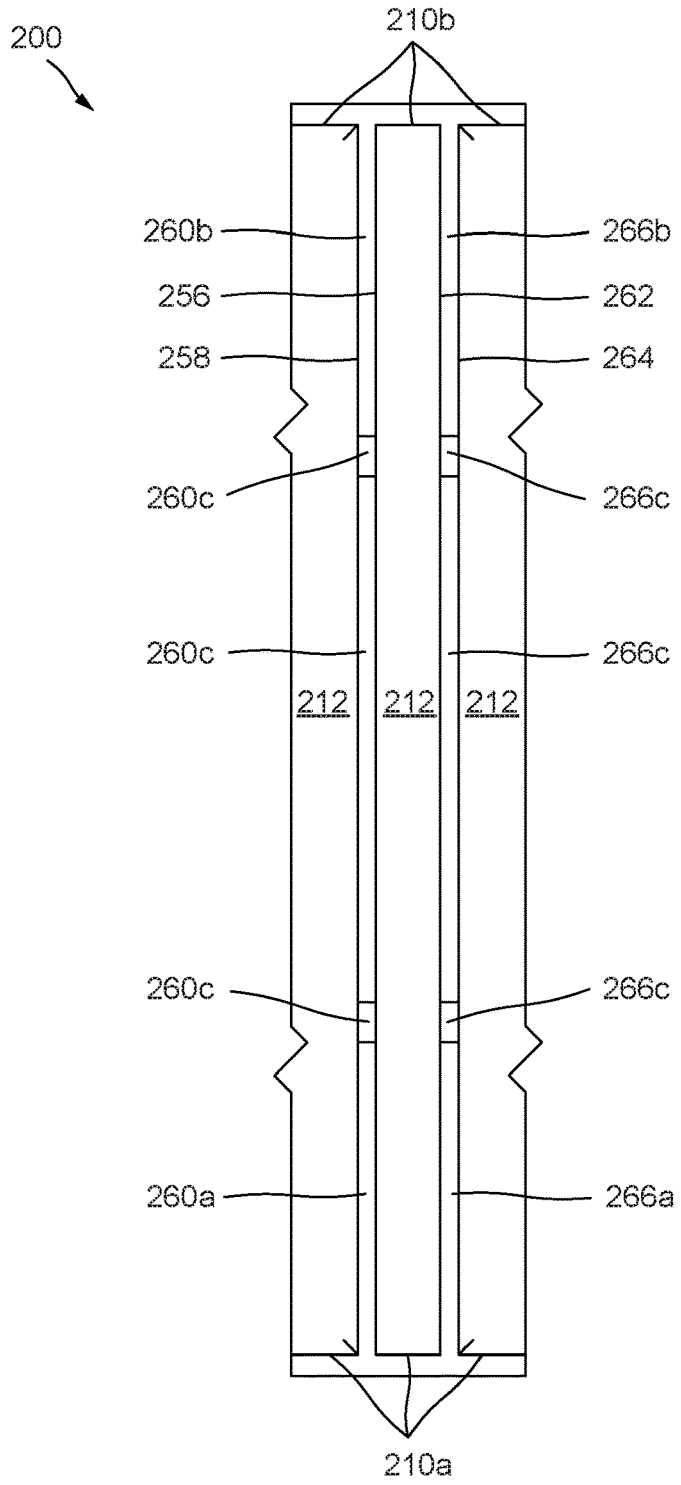
FIG. 15 is a top view of a portion of a body and divider of the case of FIG. 1.
Figure 16:
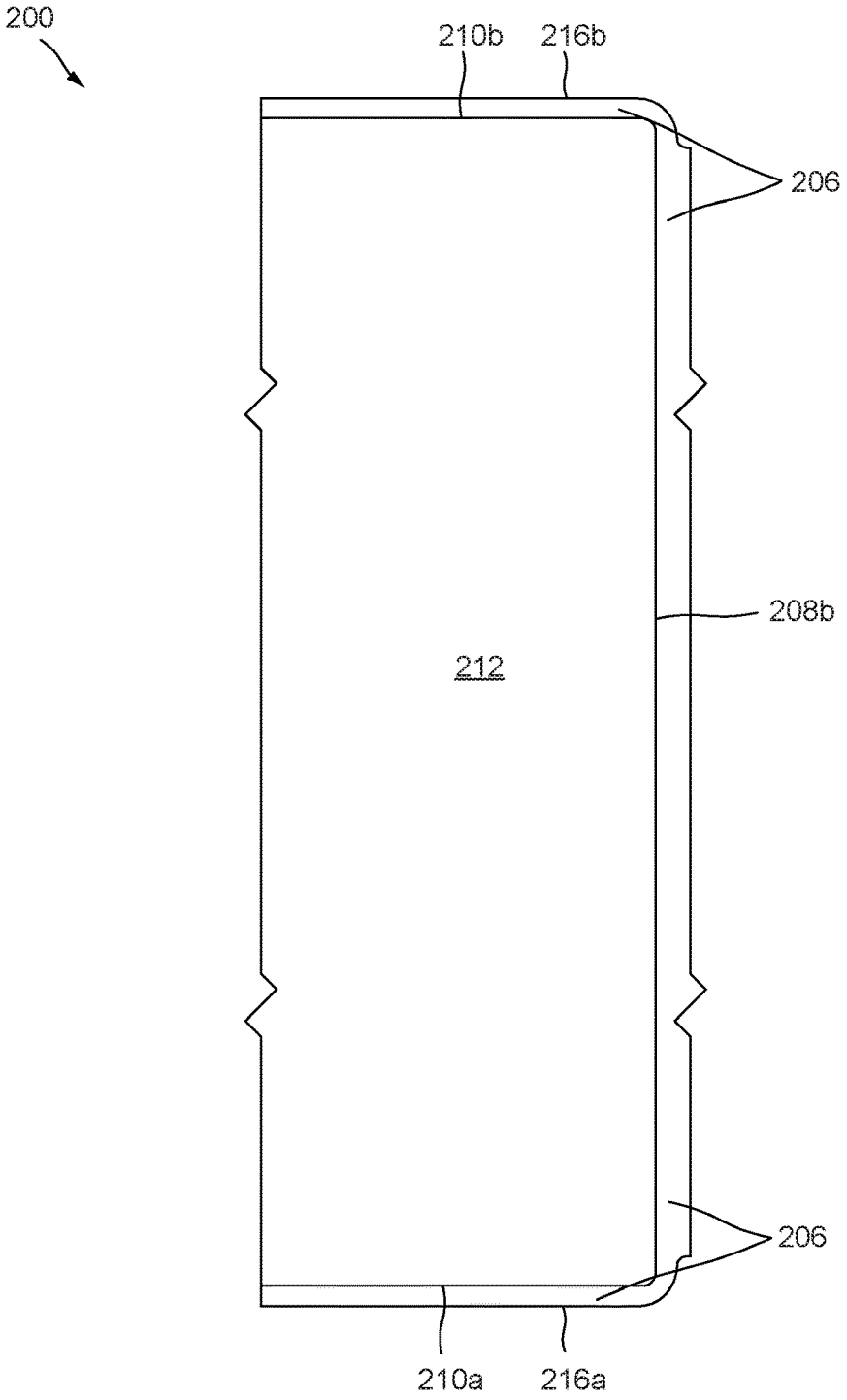
FIG. 16 is a top view of a portion of a body of the case of FIG. 1.
Figure 17:
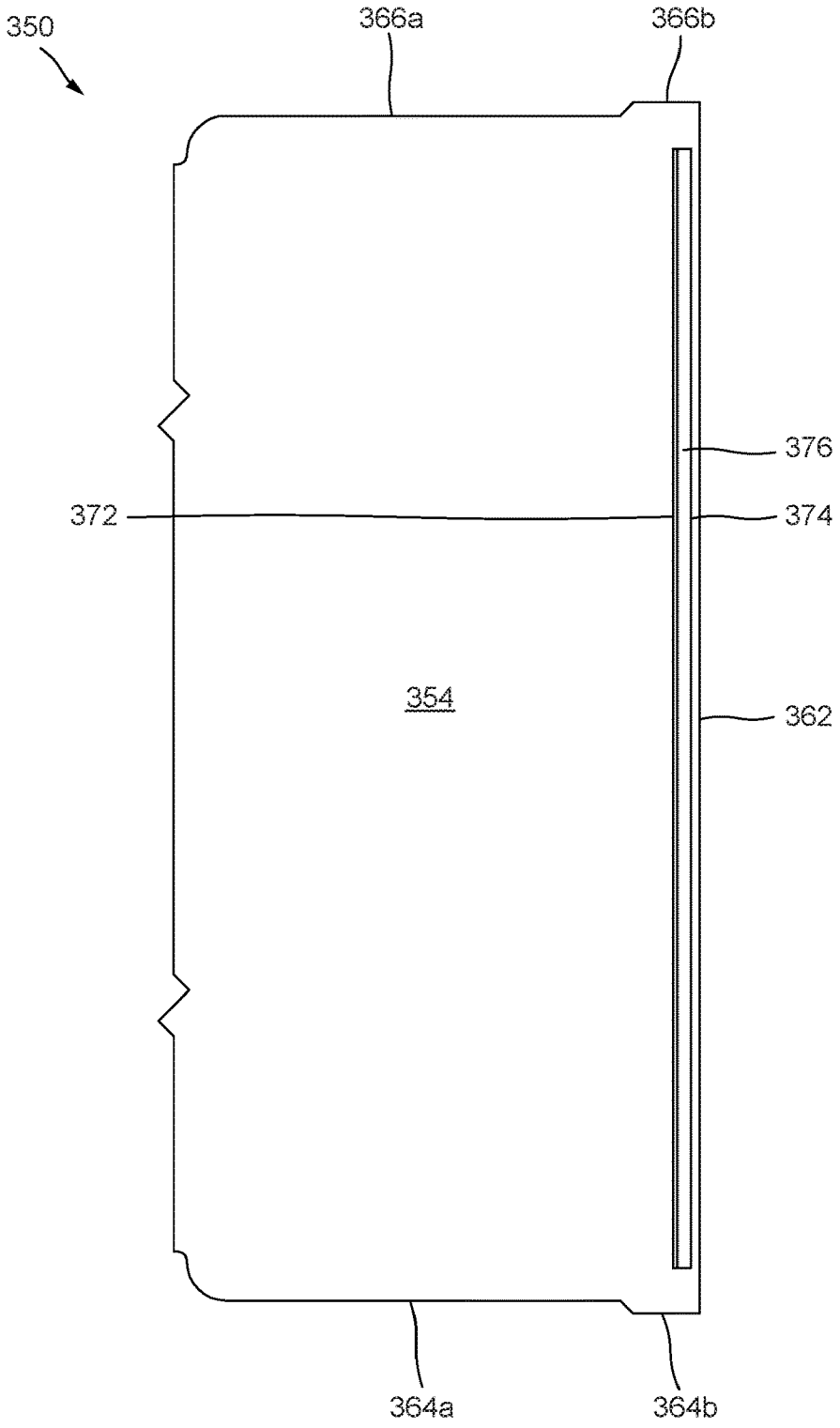
FIG. 17 is a top view of a second lid of the case of FIG. 1.
Figure 18:
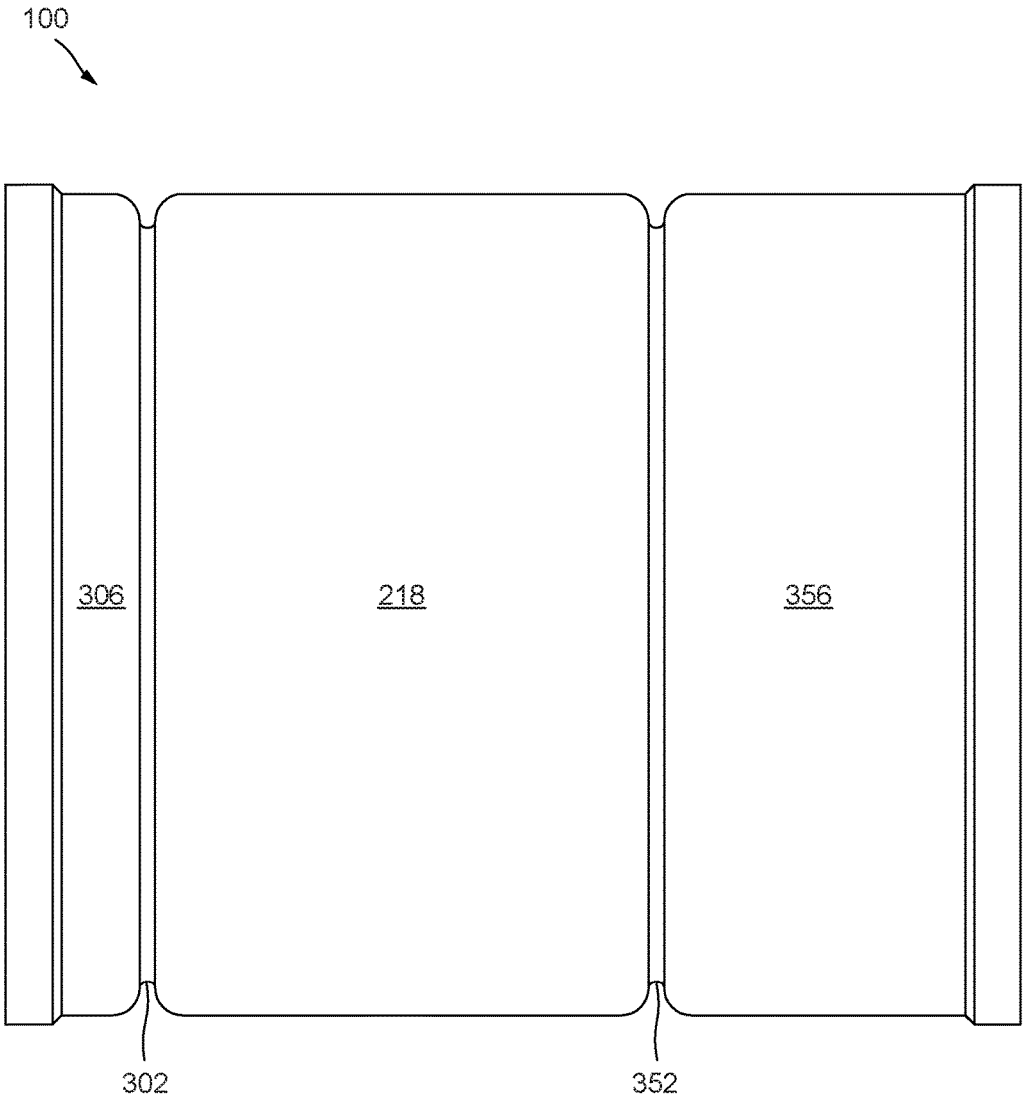
FIG. 18 is a bottom view of the case of FIG. 1 with first and second lids open.
Figure 19:
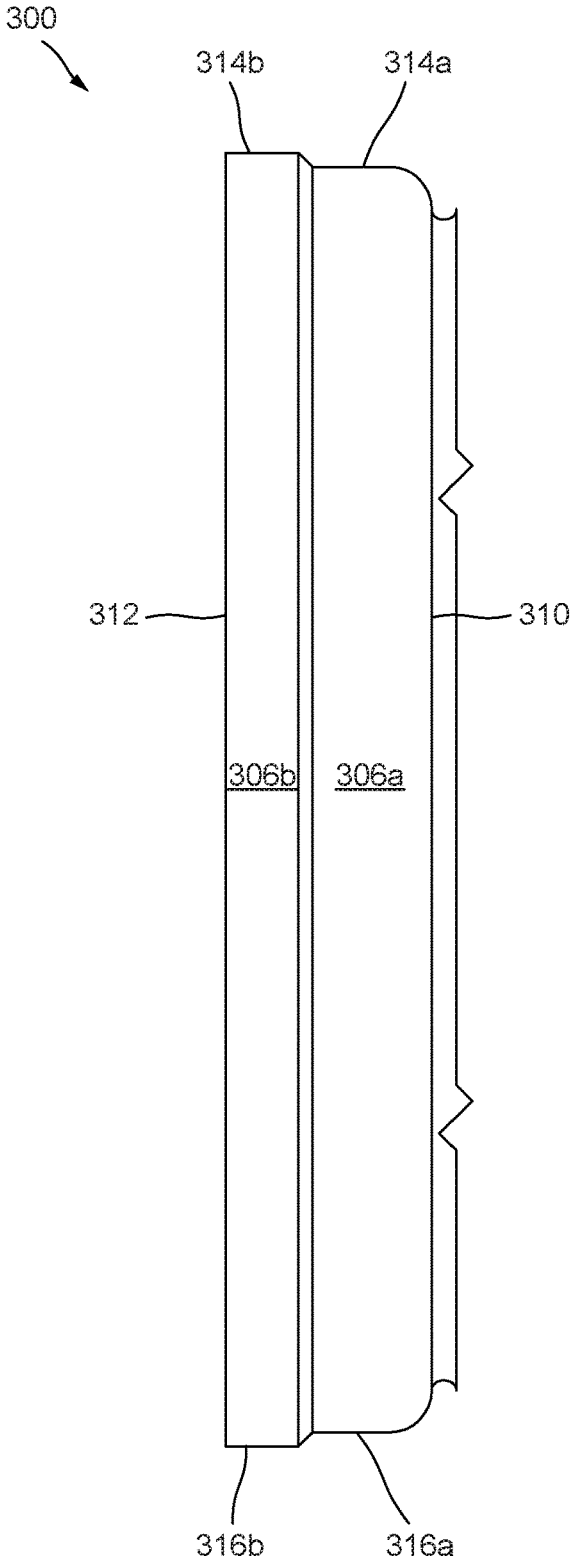
FIG. 19 is a bottom view of a first lid of the case of FIG. 1.
Figure 20:
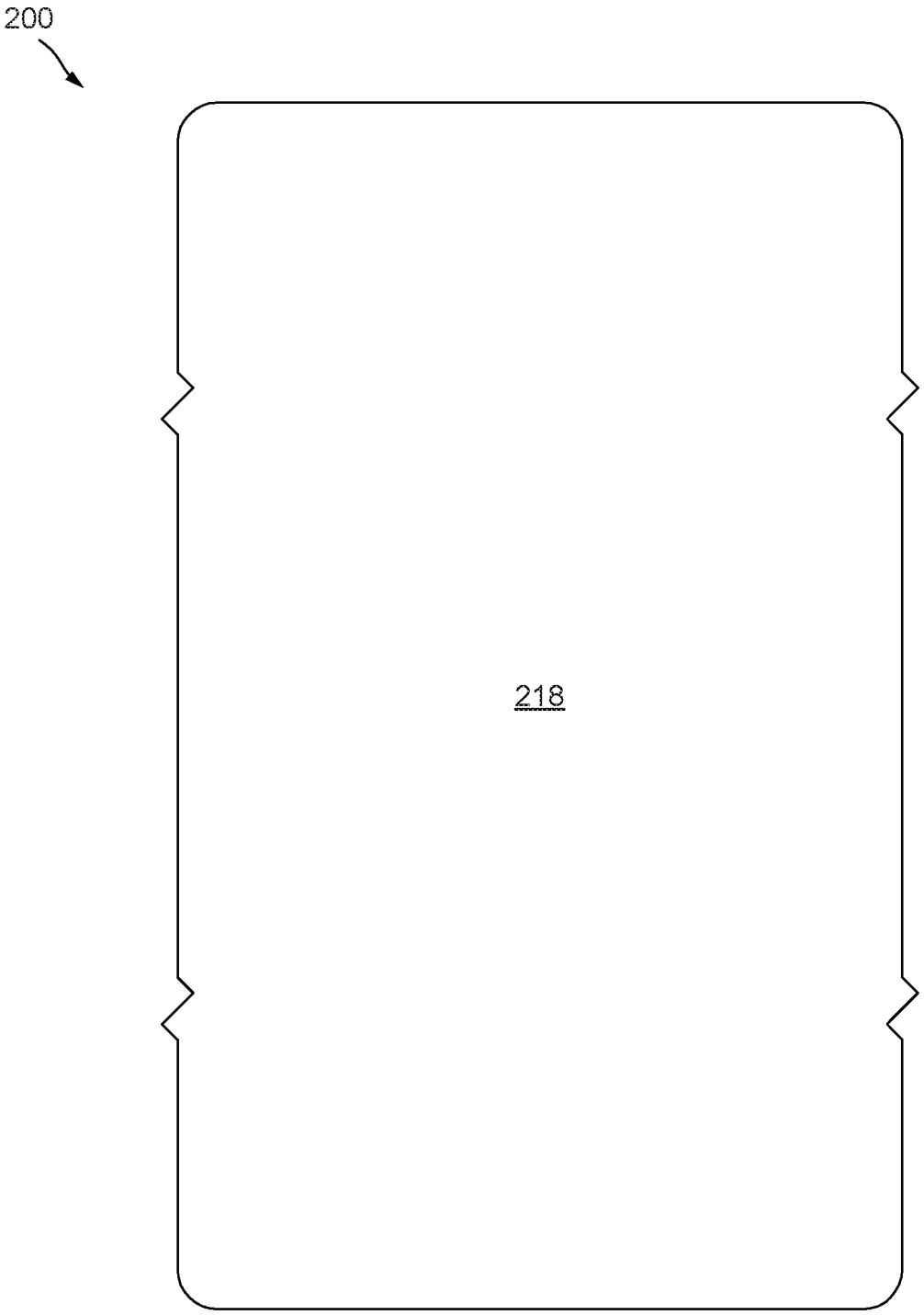
FIG. 20 is a bottom view of a body of the case of FIG. 1.
Figure 21:
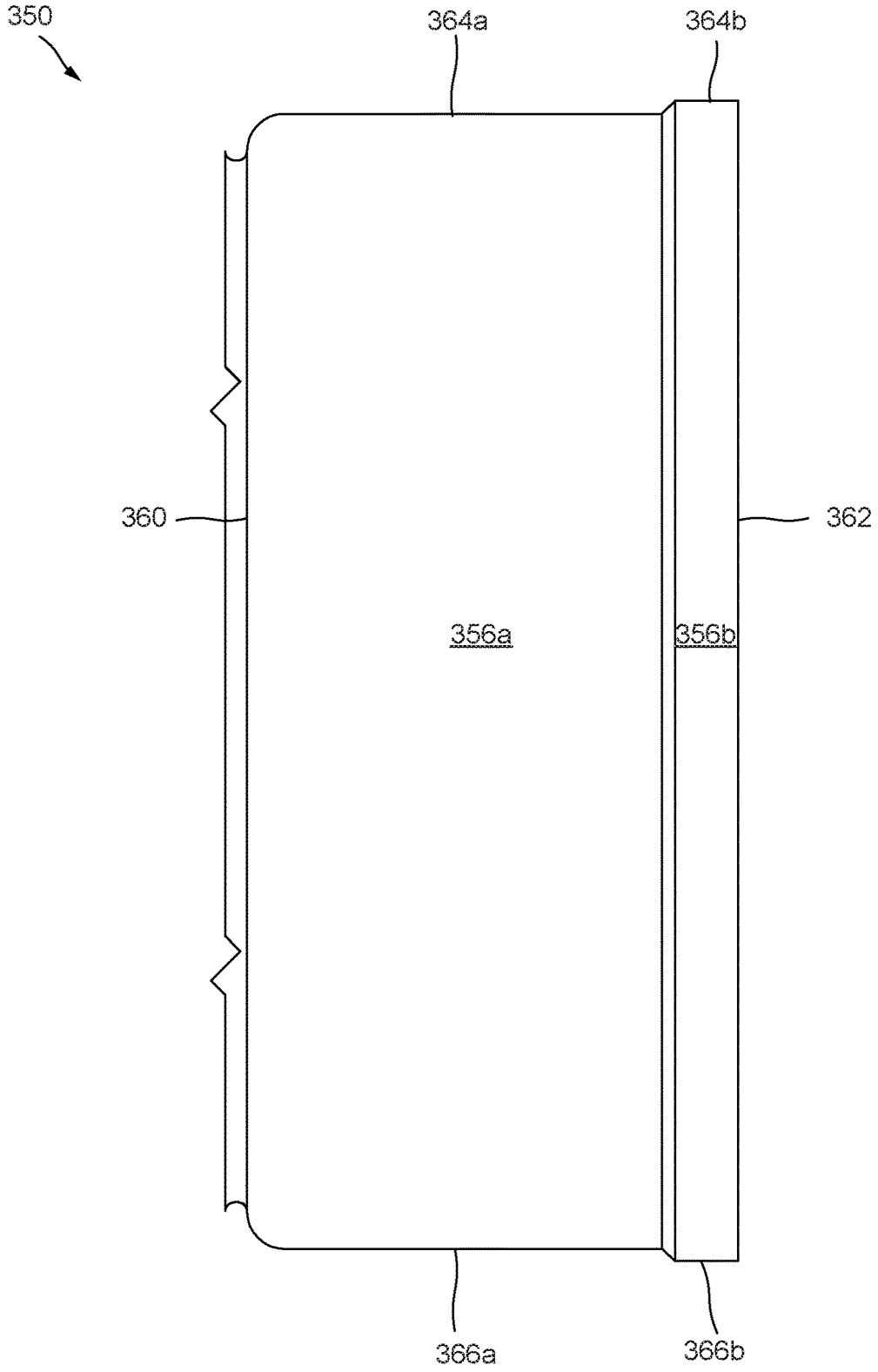
FIG. 21 is a bottom view of a second lid of the case of FIG. 1.
Figure 22:
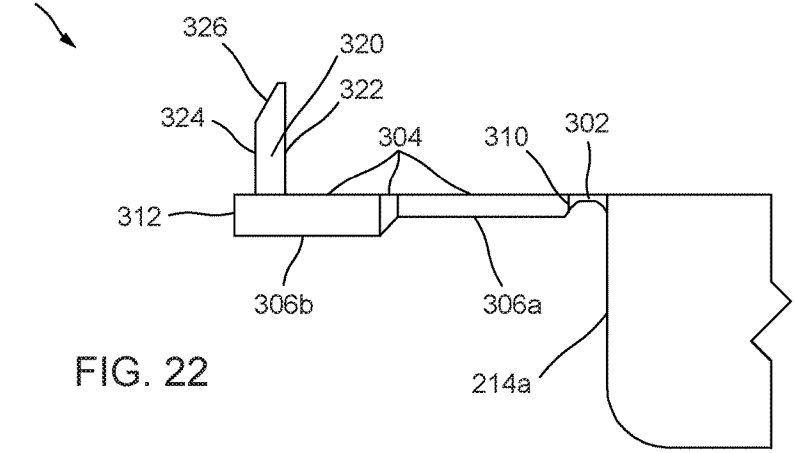
FIG. 22 is a side view of a first lid of the case of FIG. 1.
Figure 24:
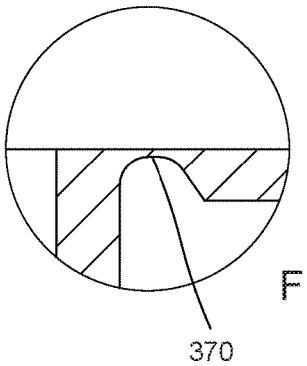
FIG. 24 is a side view of a living hinge of the case of FIG. 1.
Figure 23:
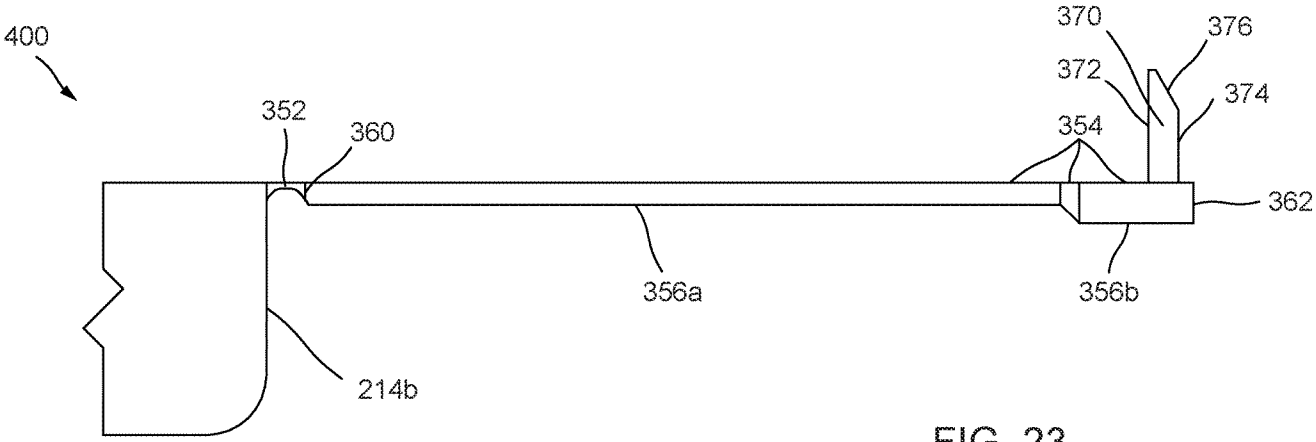
FIG. 23 is a side view of a second lid of the case of FIG. 1.
Figure 25:
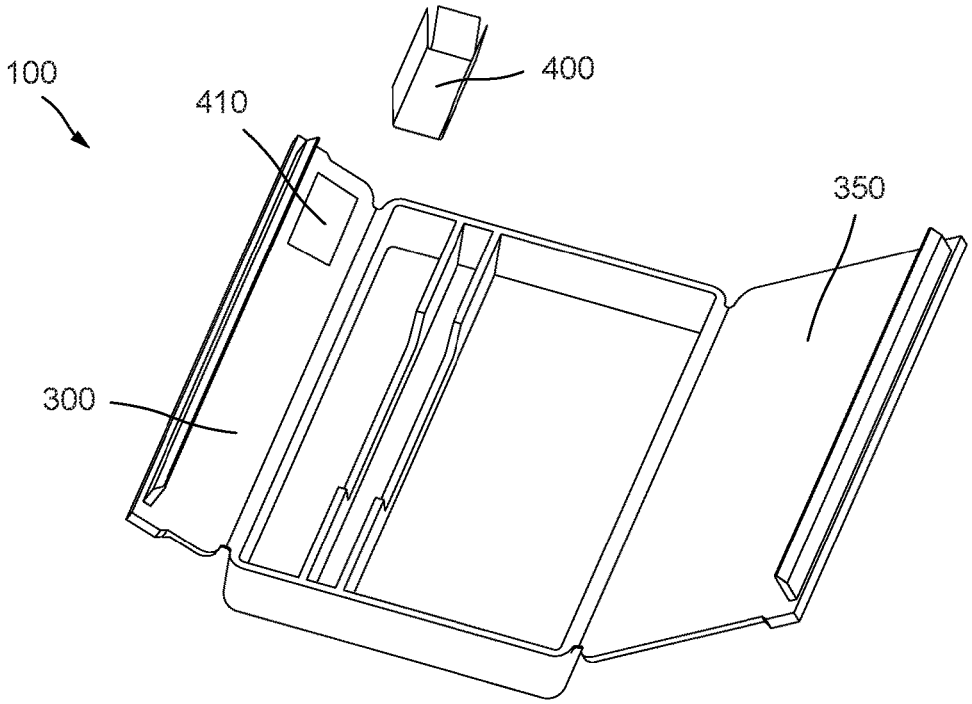
FIG. 25 is a perspective view of the case of FIG. 1 with first and second lids open, a metal cap configured for coupling to a body, and a metal cover coupled to a first cover.
Figure 26:
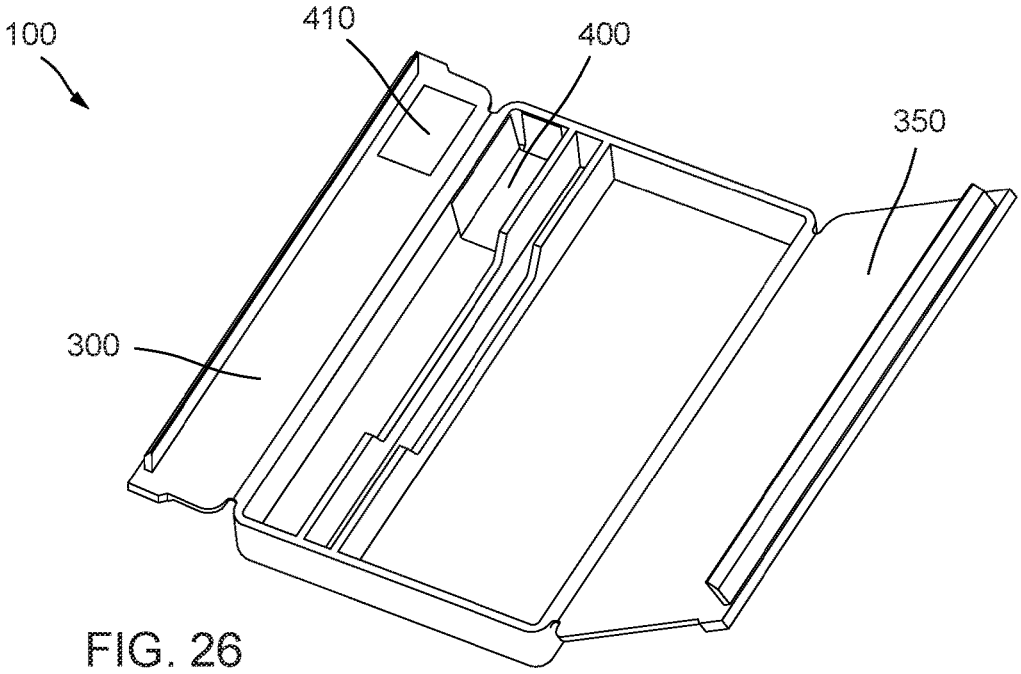
FIG. 26 is a perspective view of the case of FIG. 1 with first and second lids open, a metal cap coupled to a body, and a metal cover coupled to a first cover.
Figure 27A:
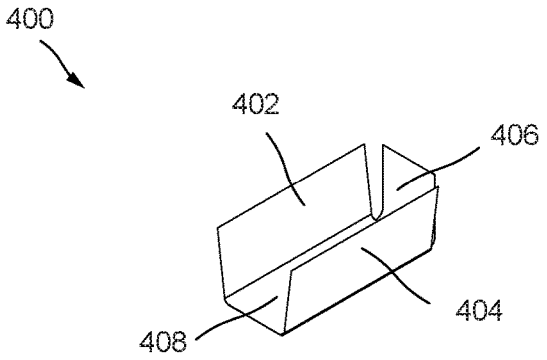
FIGS. 27*a* to 27*d* are perspective, top, side, and front views of the metal cap of FIGS. 24 and 25.
Figure 27B:
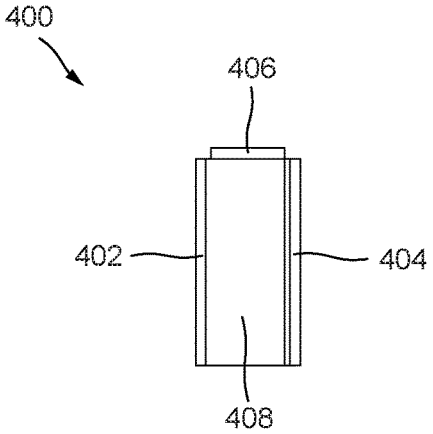
Figure 27C:
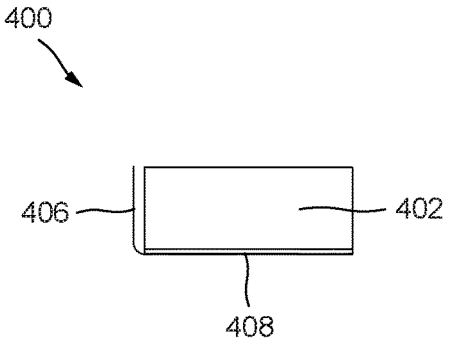
Figure 27D:
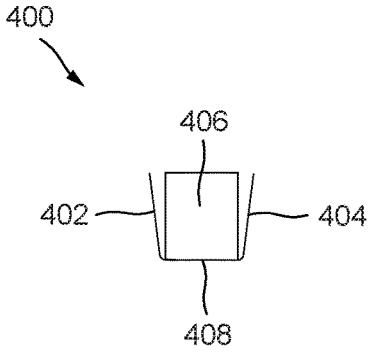

The present invention is directed to a case for storing tobacco products. Preferably, the case is made of polypropylene, although other materials can be used. FIGS. 1 through 27 show a case 100 for storing tobacco products in accordance with a first embodiment of the present invention. The case 100 of this embodiment comprises a body 200 having a cavity formed therein. An inner surface 202 defines the interior boundary of the body 200 and delimits the cavity. An outer surface 204 defines the exterior boundary of the body 200. A lip 206 defines the upper boundary of the body 200 and circumscribes the open upper end of the cavity. The lip 206 is demarcated by upper edges of the inner and outer surfaces 202 and 204 of the body 200. A divider 250 traverses the cavity and defines a boundary between first and second compartments within the cavity. A first lid 300 is pivotally coupled to the body 200 by a first hinge 302, and a second lid 350 is pivotally coupled to the body 200 by a second hinge 352.

Preferably, the divider 250 is offset from the medial centerline of the body 200. Consequently, in the preferred configuration, the first compartment has the same length and depth, but a smaller width, than the second compartment.

The case 100 may be configured such that a single tobacco product, such as a standard 70-millimeter cigarette, can be stored in the first compartment, and multiple tobacco products of the same type can be stored in the second compartment. Various embodiments of the case 100 can be configured to provide first and second compartments having dimensions allowing for the storage of specific types and quantities of tobacco products in each compartment.

The inner surface 202 of the body 200 of the first embodiment includes first and second planar lateral portions 208*a* and 208*b* that are parallel to each other, planar anterior and posterior portions 210*a* and 210*b* that are parallel to each other and perpendicular to the first and second planar lateral portions 208*a* and 208*b*, and a planar lower portion 212 that is perpendicular to the first and second planar lateral portions 208*a* and 208*b* and to the planar anterior and posterior portions 210*a* and 210*b*. As shown, the first and second planar lateral portions 208*a* and 208*b* are coupled to the planar anterior and posterior portions 210*a* and 210*b*, and to the planar lower portion 212, by concave corner surfaces. In various embodiments, some, all, or none of the adjacent planar portions 208*a*, 208*b*, 210*a*, 210*b*, and 212 may be coupled to each other by concave corner surfaces. In other embodiments (not shown), some, all, or none of the lateral, anterior, posterior, and lower portions of the inner surface 202 may be curved, rather than planar. Moreover, in some embodiments (not shown), grooves may be formed in the lower portion of the inner surface 202 to help prevent stored tobacco products from shifting within the cavity. These and other variations to the configuration of the inner surface 202 shown in the figures may be made without departing from the scope of the present invention.

The outer surface 204 of the body 200 of the first embodiment similarly includes first and second planar lateral portions 214*a* and 214*b* that are parallel to each other, planar anterior and posterior portions 216*a* and 216*b* that are parallel to each other and perpendicular to the first and second planar lateral portions 214*a* and 214*b*, and a planar lower portion 218 that is perpendicular to the first and second planar lateral portions 214*a* and 214*b* and to the planar anterior and posterior portions 216*a* and 216*b*. As shown, the second planar lateral portions 214*a* and 214*b* and the planar anterior and posterior portions 216*a* and 216*b* are coupled to each other, and to the planar lower portion 218, by convex corner surfaces. In various embodiments, some, all, or none of the adjacent portions 214*a*, 214*b*, 216*a*, 216*b*, and 218 may be coupled to each other by convex corner surfaces. In other embodiments (not shown), some, all, or none of the lateral, anterior, posterior, and lower portions of the outer surface 204 may be curved, rather than planar. For example, in some embodiments (not shown), the entire outer surface 204 may be curved, without having any visibly distinct lateral, anterior, posterior, and lower portions. These and other variations to the configuration of the outer surface 204 shown in the figures may be made without departing from the scope of the present invention.

The lip 206 of the body 200 of the first embodiment is a thin planar surface demarcated by upper edges of the inner and outer surfaces 202 and 204 of the body 200. In other embodiments, the lip 206 of the body 200 may have other configurations. For example, in some embodiments, the lip may be a convex surface extending upwards between the upper edges of the inner and outer surfaces 202 and 204 of the body 200, or may be a concave surface extending downward between the upper edges of the inner and outer surfaces 202 and 204 of the body 200. In other embodiments, the lip 206 of the body 200 may be an edge formed by the direct coupling of the upper edges of the inner and outer surfaces 202 and 204 of the body 200.

The divider 250 of the first embodiment has a slot formed therein and comprises first and second walls 252 and 254. Both the first and second walls 252 and 254 are coupled at anterior ends to the planar anterior portion 210*a* of the inner surface 202 of the body 200, at posterior ends to the planar posterior portion 210*b* of the inner surface 202 of the body 200, and at lower ends to the planar lower portion 212 of the inner surface 202 of the body 200. The first wall 252 has a first surface 256 that partially delimits the slot, a second surface 258 that partially delimits the first compartment, and a lip 260 that defines the upper boundary of the first wall 252 and is demarcated by upper edges of the first and second surfaces 256 and 258 of the first wall 252. Similarly, the second wall 254 has a first surface 262 that partially delimits the slot, a second surface 264 that partially delimits the second compartment, and a lip 266 that defines the upper boundary of the second wall 254 and is demarcated by upper edges of the first and second surfaces 262 and 264 of the second wall 254. The first and second surfaces 256 and 258 of the first wall 252, and the first and second surfaces 262 and 264 of the second wall 254, include planar lateral portions that are parallel to each other and to the first and second planar lateral portions 208*a* and 208*b* of the inner surface 202 of the body 200, and are perpendicular to the planar anterior and posterior portions 210*a* and 210*b*, and to the planar lower portion 212, of the inner surface 202 of the body 200. As shown, the planar lateral portions of the second surfaces 258 and 264 of the first and second walls 252 and 254 are coupled to the lower planar portion 212 of the inner surface 202 of the body 200 by concave corner surfaces. In various embodiments, some, all, or none of the planar lateral portions of the first and second surfaces 256, 258, 262, and 264 may be coupled to the anterior planar portion 210*a*, the posterior planar portion 210*b*, and/or the planar lower portion 212 of the inner surface of the inner surface 202 of the body 200 by concave corner surfaces.

The first and second walls 252 and 254 of the first embodiment may each have a recess formed therein. In this configuration, the lip 260 of the first wall 252 has anterior and posterior portions 260*a* and 260*b* that are contiguous and coplanar with the lip 206 of the body 200, and an intermediate portion 260*c* that extends downward between the anterior and posterior portions 260*a* and 260*b* of the lip 260 of the first wall 252. The inner surface 304 of the first lid 300 contacts the anterior and posterior portions 260*a* and 260*b* of the lip 260 of the first wall 252 when the first lid 300 is in the closed position. The intermediate portion 260*c* of the lip 260 of the first wall 252 delimits the recess formed in the first wall 252.

Similarly, the lip 266 of the second wall 254 has anterior and posterior portions 266*a* and 266*b* that are contiguous and coplanar with the lip 206 of the body 200, and an intermediate portion 266*c* that extends downward between the anterior and posterior portions 266*a* and 266*b* of the lip 266 of the second wall 254. The inner surface 354 of the second lid 350 contacts the anterior and posterior portions 266*a* and 266*b* of the lip 266 of the second wall 252 when the second lid 350 is in the closed position. The intermediate portion 266*c* of the lip 266 of the second wall 254 delimits the recess formed in the first wall 254.

Preferably, the anterior and posterior portions 260*a* and 260*b* of the lip 260 of the first wall 252, and the anterior and posterior portions 266*a* and 266*b* of the lip 266 of the second wall 254, are thin planar surfaces, although other configurations are contemplated as falling within the scope of the invention. For example, the anterior and posterior portions 260*a* and 260*b* of the lip 260, and the anterior and posterior portions 266*a* and 260*b* of the lip 266 of the second wall 254, may be convex surfaces, concave surfaces, or edges formed by the direct coupling of the upper edges of the first and second surfaces 256 and 258, of the first wall 252, and of the first and second surfaces 262 and 264 of the second wall 254.

The recesses formed in the first and second walls 252 and 254 may be configured to facilitate the removal of tobacco products stored in the first and second compartments. In one configuration, the intermediate portions 260*c* and 266*c* of the first and second walls 252 and 254 both include multiple straight surfaces that delimit recesses having an isosceles trapezoidal shape. Other configurations of the intermediate portions 260*c* and 266*c* of the first and second walls 252 and 254 delimiting recesses having different shapes are contemplated as falling within the scope of the present invention.

The first lid 300 has an inner surface 304, an outer surface 306, and a rim 308 that is demarcated by peripheral edges of the inner and outer surfaces 304 and 306 of the first lid 300. The first hinge 302 allows the first lid 300 to pivot back and forth from an open position to a closed position. When the first lid 300 is in the open position, the first compartment is accessible through the lip 206 of the body 200. When the first lid 300 is in the closed position, the first compartment is enclosed by the body 200, the divider 250, and the first lid 300, and the inner surface 304 of the first lid 300 contacts the lip 206 of the body 200.

Similarly, the second lid 350 has an inner surface 354, an outer surface 356, and a rim 358 that is demarcated by peripheral edges of the inner and outer surfaces 354 and 356 of the second lid 350. The second hinge 352 allows the second lid 350 to pivot back and forth from an open position to a closed position. When the second lid 350 is in the open position, the second compartment is accessible through the lip 206 of the body 200. When the second lid 350 is in the closed position, the second compartment is enclosed by the body 200, the divider 250, and the second lid 350, and the inner surface 354 of the second lid 350 contacts the lip 206 of the body 200. In the preferred configuration, in which the divider 250 is offset from the centerline of the body, and the first compartment consequently has a smaller width than the second compartment, the first lid 300 will have a smaller width than the second lid 350.

The rim 308 of the first lid 300 may include a proximal portion 310 and a distal portion 312. The case 100 is configured such that the distal portion 312 of the rim 308 rotates around the proximal portion 310 of the rim 308 when the first lid 300 pivots back and forth from the open position to the closed position. Preferably, the hinge 302 is a living hinge that pivotally couples the proximal portion 310 of the rim 308 of the first lid 300 to the upper end of the first planar lateral portion 214*a* of the outer surface 204 of the body 200, although other types of hinges can be used. The proximal and distal portions 310 and 312 of the rim 308 of the first embodiment are both thin planar surfaces that are parallel to each other.

The rim 308 of the first lid 300 may also include an anterior portion 314 and a posterior portion 316. Preferably, the anterior portion 314 of the rim 308 of the first lid 300 includes a principal portion 314*a* that is coplanar with the outer surface 204 of the body 200. The anterior portion 314 of the rim 308 of the first lid 300 may also include at its distal end a projecting portion 314*b* that extends outward from the principal portion 314*a* so as to overhang the outer surface 204 of the body 200. Similarly, the posterior portion 316 of the rim 308 of the first lid 300 preferably includes a principal portion 316*a* that is coplanar with the outer surface 204 of the body 200. The posterior portion 316 of the rim 308 of the first lid 300 may also include at its distal end a projecting portion 316*b* that extends outward from the principal portion 316*a* so as to overhang the outer surface 204 of the body 200.

The inner surface 304 of the first lid 300 of the first embodiment is planar. The outer surface 306 of the first lid 300 of the first embodiment includes an inferior portion 306*a* and an elevated portion 306*b*. Preferably, the elevated portion 306*b* is formed at a distal end of the outer surface 306 of the first lid 300 and extends upward from the inferior portion 306*a* of the outer surface 306 of the first lid 300. The elevated portion 306*b* may help a user of the case 100 to identify the location of the distal edge of the first lid 300, making it easier for the user to open the first lid 300. In furtherance of this objective, the inferior and elevated portions 306*a* and 306*b* of the outer surface 306 of the first lid 300 may be different colors or provided with different textures.

The rim 358 of the second lid 350 may include a proximal portion 360 and a distal portion 362. The case 100 is configured such that the distal portion 362 of the rim 358 rotates around the proximal portion 360 of the rim 358 when the second lid 350 pivots back and forth from the open position to the closed position. Preferably, the hinge 352 is a living hinge that pivotally couples the proximal portion 360 of the rim 358 of the second lid 350 to the upper end of the second planar lateral portion 214*b* of the outer surface 204 of the body 200, although other types of hinges can be used. The proximal and distal portions 360 and 362 of the rim 358 of the first embodiment are both thin planar surfaces that are parallel to each other.

The rim 358 of the second lid 350 may also include an anterior portion 364 and a posterior portion 366. Preferably, the anterior portion 364 of the rim 358 of the second lid 350 includes a principal portion 364*a* that is coplanar with the outer surface 204 of the body 200. The anterior portion 364 of the rim 358 of the second lid 350 may also include at its distal end a projecting portion 364*b* that extends outward from the principal portion 364*a* so as to overhang the outer surface 204 of the body 200. Similarly, the posterior portion 366 of the rim 358 of the second lid 350 preferably includes a principal portion 366*a* that is coplanar with the outer surface 204 of the body 200. The posterior portion 366 of the rim 358 of the second lid 350 may also include at its distal end a projecting portion 366*b* that extends outward from the principal portion 366*a* so as to overhang the outer surface 204 of the body 200.

The inner surface 354 of the second lid 350 of the second embodiment is planar. The outer surface 356 of the second lid 350 of the first embodiment includes an inferior portion 356*a* and an elevated portion 356*b*. Preferably, the elevated portion 356*b* is formed at a distal end of the outer surface 356 of the second lid 350 and extends upward from the inferior portion 356*a* of the outer surface 356 of the second lid 350. The elevated portion 356*b* may help a user of the case 100 to identify the location of the distal edge of the second lid 350, making it easier for the user to open the second lid 350. In furtherance of this objective, the inferior and elevated portions 356*a* and 356*b* of the outer surface 356 of the second lid 350 may be different colors or provided with different textures.

The case of the first embodiment includes a first arm 320 extending outward from the inner surface 304 of the first lid 300, and a second arm 370 extending outward from the inner surface 354 of the second lid 350. The first arm 320 includes first and second surfaces 322 and 324 defining opposite sides of the first arm 320. Preferably, the first and second surfaces 322 and 324 each include a planar portion. The planar portions of the first and second surfaces 322 and 324 are preferably parallel to each other and to the proximal and distal portions 310 and 312 of the rim 308 of the first lid 300, and are preferably perpendicular to the inner surface 304 of the first lid 300. Distal edges of the first and second surfaces 322 and 324 may be coupled to each other by a bevel or a chamfer 326.

The first arm 320 is configured to be received within the slot formed in the divider 250 such that the first surface 322 of the first arm 320 is positioned flush against the first surface of the first wall 252 of the divider 250 when the first lid 300 is in the closed position, thereby detachably coupling the first lid 300 to the divider 250 by achieving an interference fit between the first arm 320 and the divider 250. Preferably, the interference fit between the first arm 320 and the divider 250 maintains the first lid 320 in its closed position until it is manually opened by a user. The shape and thickness of the first wall 252 and the first arm 320, the positions of the first wall 252 and the first arm 320 with respect to each other within the case 100, and the materials used to make the case 100 can be varied to manipulate the amount of interference between the first arm 320 and the divider 250 when the first lid 300 is in the closed position, thereby adjusting the amount of force required to open the first lid 300.

Similarly, the second arm 370 includes first and second surfaces 372 and 374 defining opposite sides of the second arm 370. Preferably, the first and second surfaces 372 and 374 each include a planar portion. The planar portions of the first and second surfaces 372 and 374 are preferably parallel to each other and to the proximal and distal portions 360 and 362 of the rim 358 of the second lid 350, and are preferably perpendicular to the inner surface 354 of the second lid 350. Distal edges of the first and second surfaces 372 and 374 may be coupled to each other by a bevel or a chamfer 376.

The second arm 370 is configured to be received within the slot formed in the divider 250 such that the first surface 372 of the second arm 370 is positioned flush against the first surface of the second wall 254 of the divider 250 when the second lid 350 is in the closed position, thereby detachably coupling the first lid 300 to the divider 250 by achieving an interference fit between the second arm 370 and the divider 250. Preferably, the interference fit between the second arm 370 and the divider 250 maintains the second lid 370 in its closed position until it is manually opened by a user. The shape and thickness of the second wall 254 and the second arm 370, the positions of the second wall 254 and the second arm 370 with respect to each other within the case 100, and the materials used to make the case 100 can be varied to manipulate the amount of interference between the second arm 370 and the divider 250 when the second lid 350 is in the closed position, thereby adjusting the amount of force required to open the second lid 350.

The first and second compartments are sufficiently sealed when the lids 300 and 350 are in the closed position that a burning tobacco product stored in either compartment will be quickly extinguished due to a lack of oxygen when the lid for that compartment is moved to the closed position. Thus, a partially-consumed tobacco product can be stored in the first compartment, while multiple unsmoked tobacco products can simultaneously be stored in the second compartment, without smoke or ashes from the partially-consumed tobacco product contaminating the unsmoked tobacco products. A metal cap 400 having first and second lateral portions 402 and 404, a posterior portion 406, and a lower portion 408, as shown in FIGS. 27*a* through 27*d*, can be affixed within the first compartment in the manner shown in FIGS. 25 and 26 to help prevent damage to the base 200 that could be caused by a burning cigarette. Similarly, a metal lid 410 can be affixed to the inner surface of the first lid 300 so as to face the lower portion of the metal cap 400 when the first lid is in the closed position, helping to prevent any damage to the first lid 300 that could be caused by a burning cigarette. The metal cap 400, and the metal lid 410, may both be made of aluminum, although other suitable metals can be used without departing from the scope of the invention.

Figure 28:
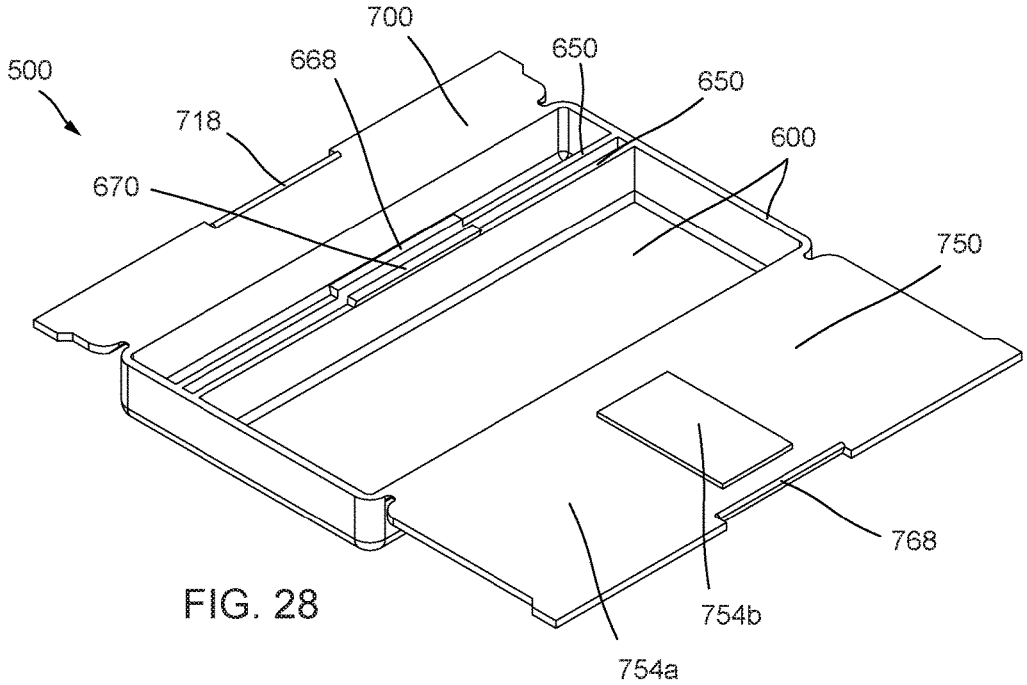
FIG. 28 is a perspective view of a case for storing tobacco products in accordance with another embodiment of the present invention with first and second lids open.
Figure 29:
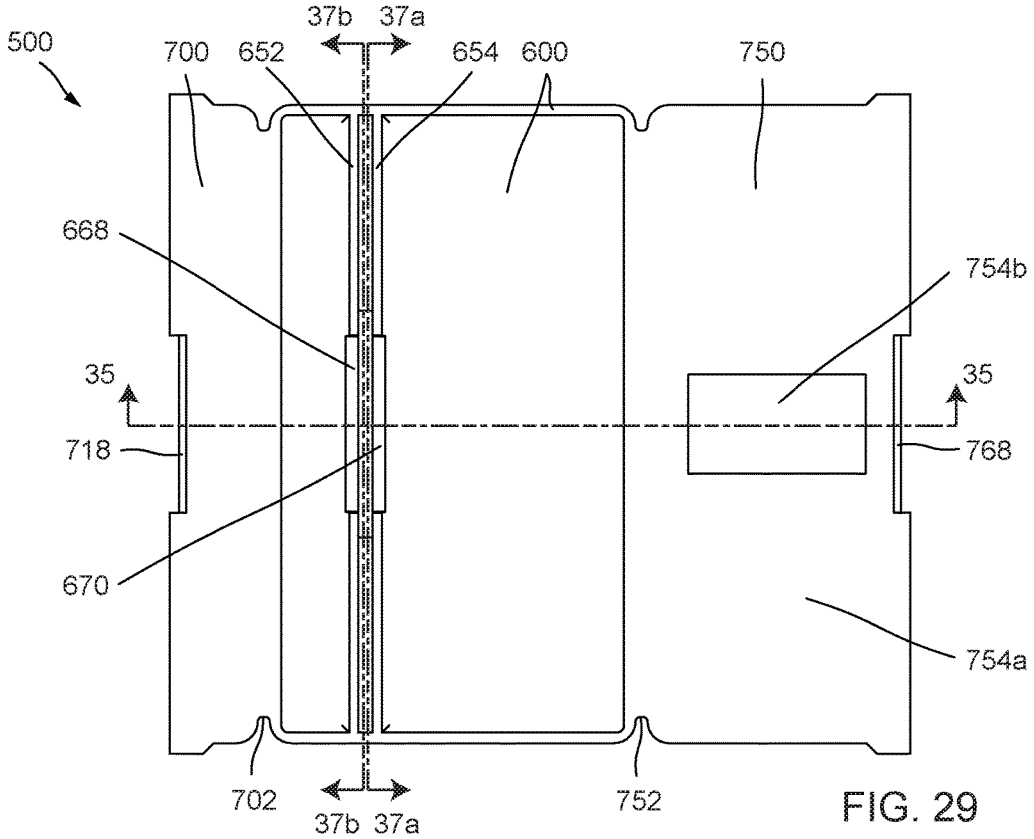
FIG. 29 is a top view of the case of FIG. 28 with first and second lids open.
Figure 30:
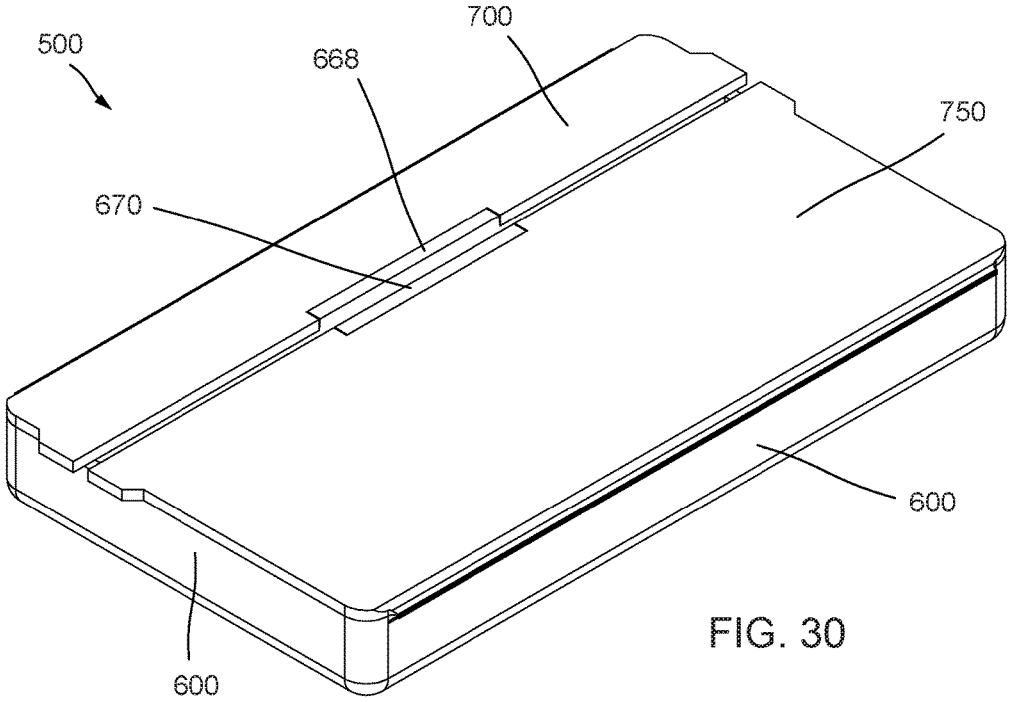
FIG. 30 is a perspective view of the case of FIG. 28 with first and second lids closed.
Figure 31:
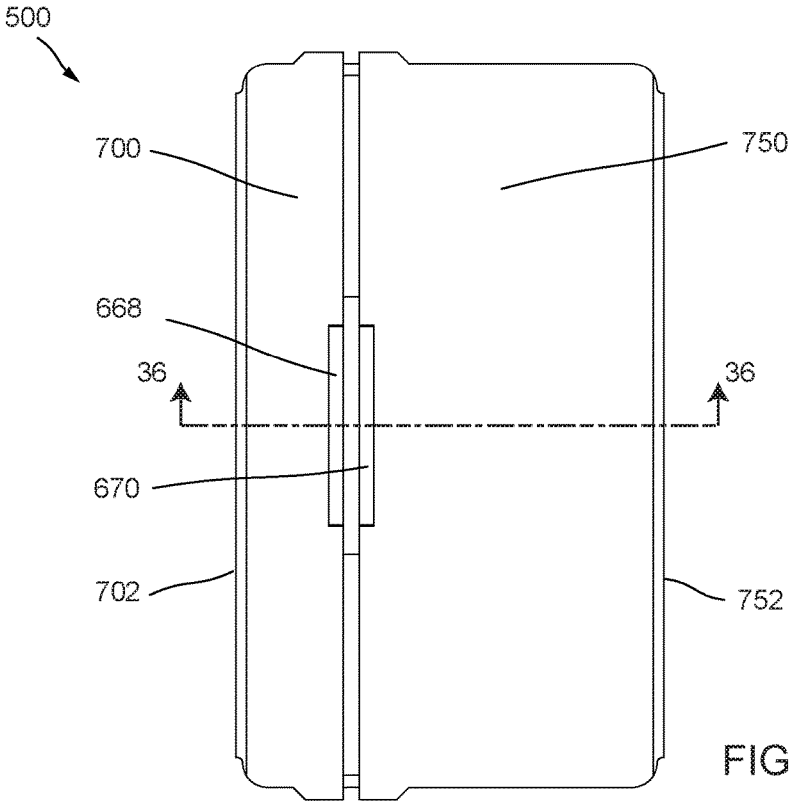
FIG. 31 is a top view of the case of FIG. 28 with first and second lids closed.
Figure 32:
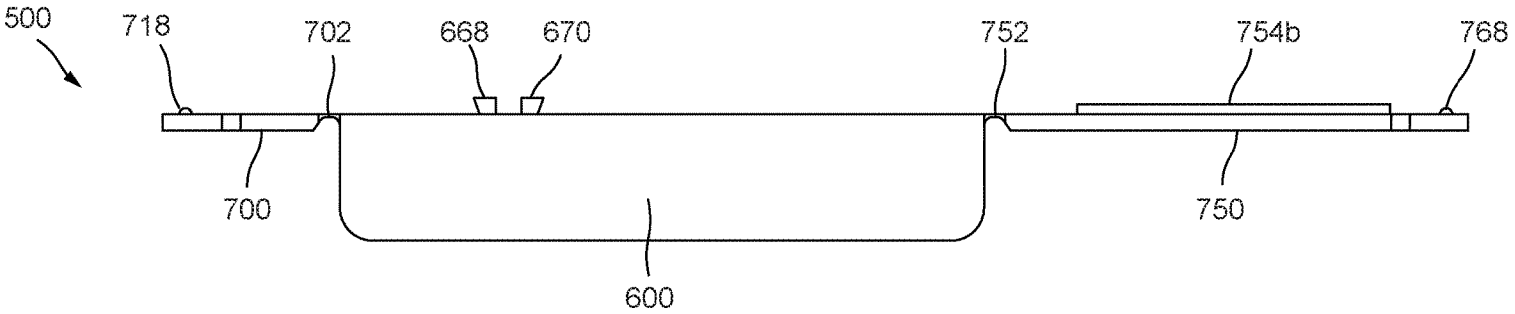
FIG. 32 is an end view of the case of FIG. 28 with first and second lids open.
Figure 33:
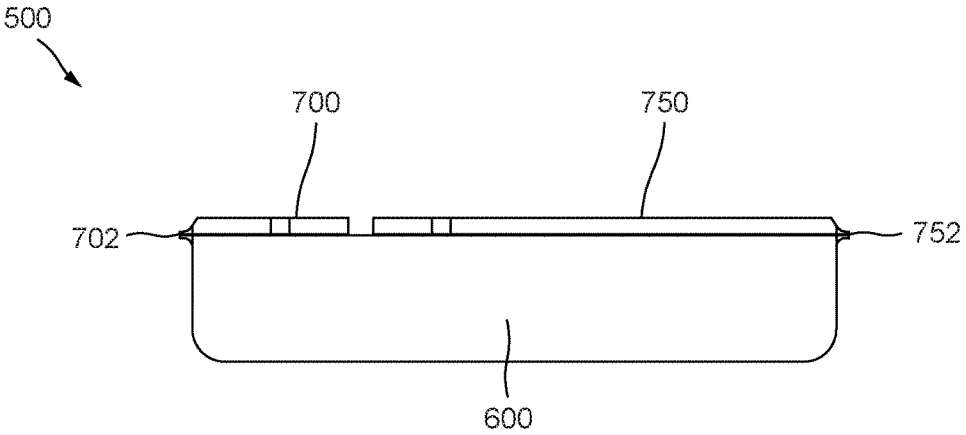
FIG. 33 is an end view of the case of FIG. 28 with first and second lids closed.
Figure 34A:
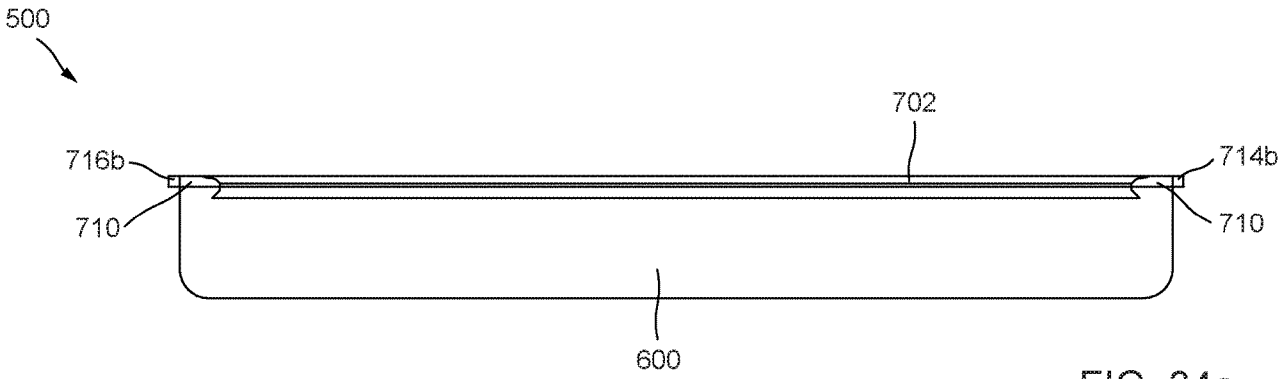
FIGS. 34*a* and 34*b* are side views of the case of FIG. 28 with first and second lids closed.
Figure 34B:
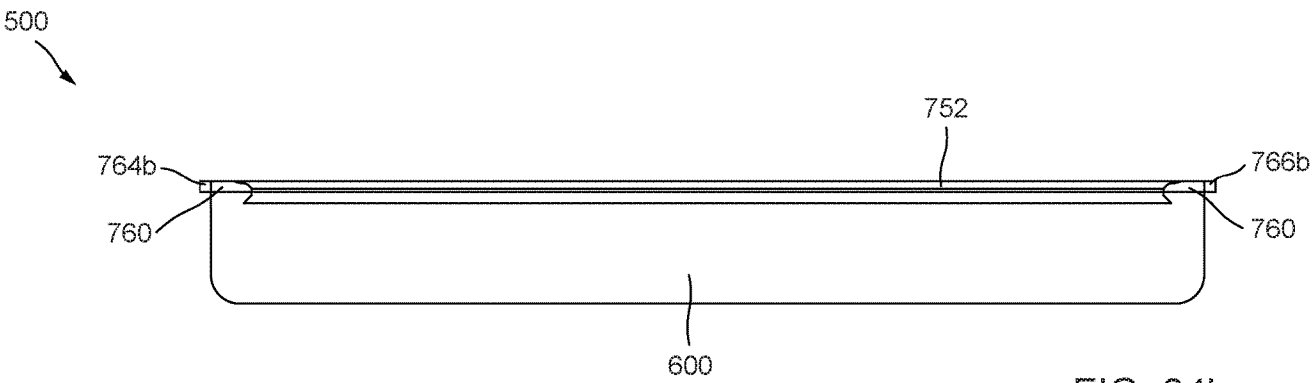
Figure 35:
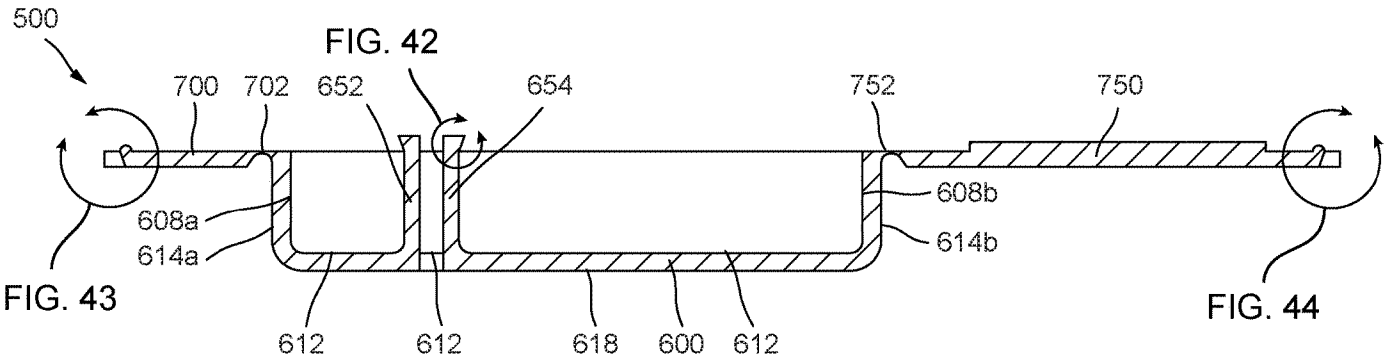
FIG. 35 is a cross-sectional view through a vertical plane showing the interior of the case of FIG. 28 with first and second lids open.
Figure 36:
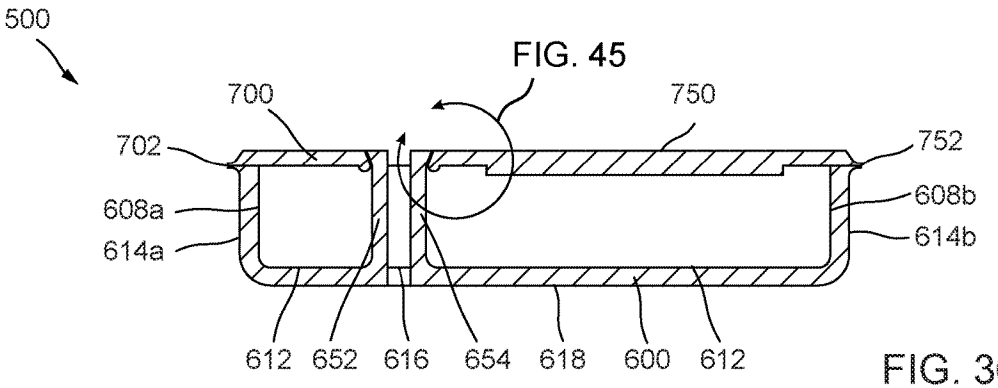
FIG. 36 is a cross-sectional view through a vertical plane showing the interior of the case of FIG. 28 with first and second lids closed.
Figure 37A:
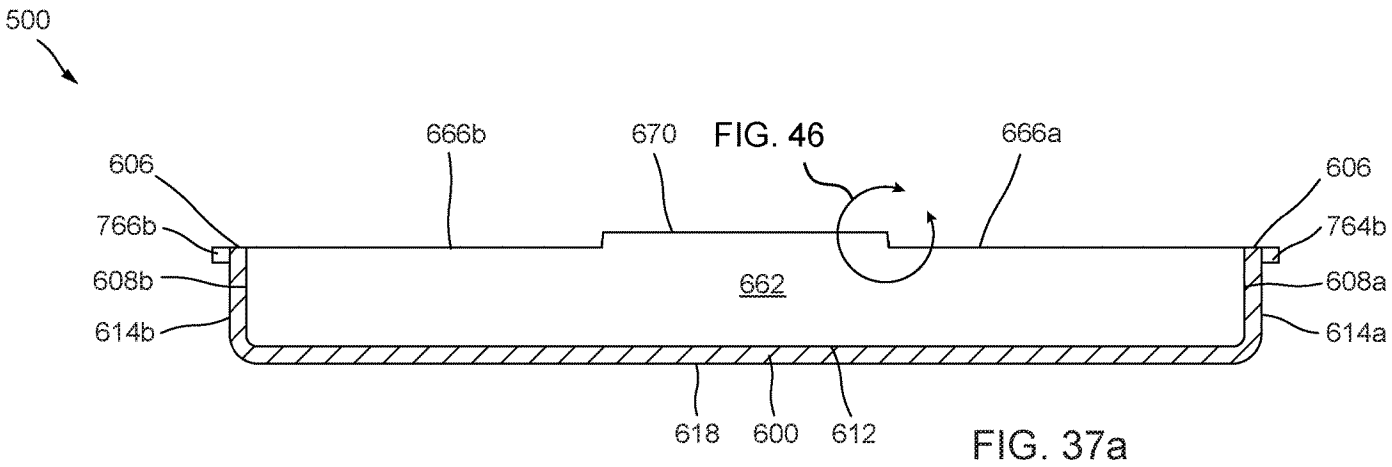
FIGS. 37*a* and 37*b* are cross-sectional views through a vertical plane showing the interior of the case of FIG. 28 with first and second lids open.
Figure 37B:
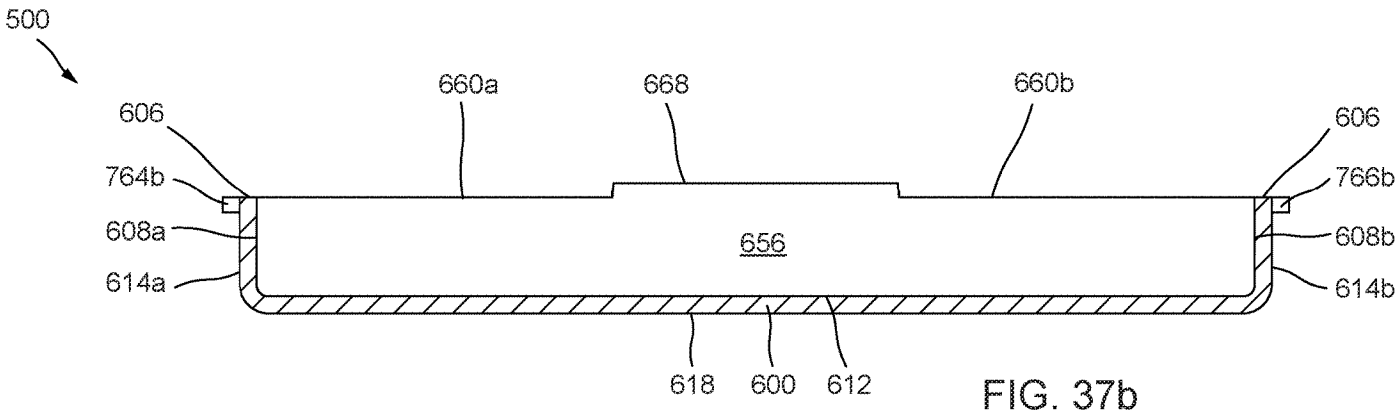
Figure 38:
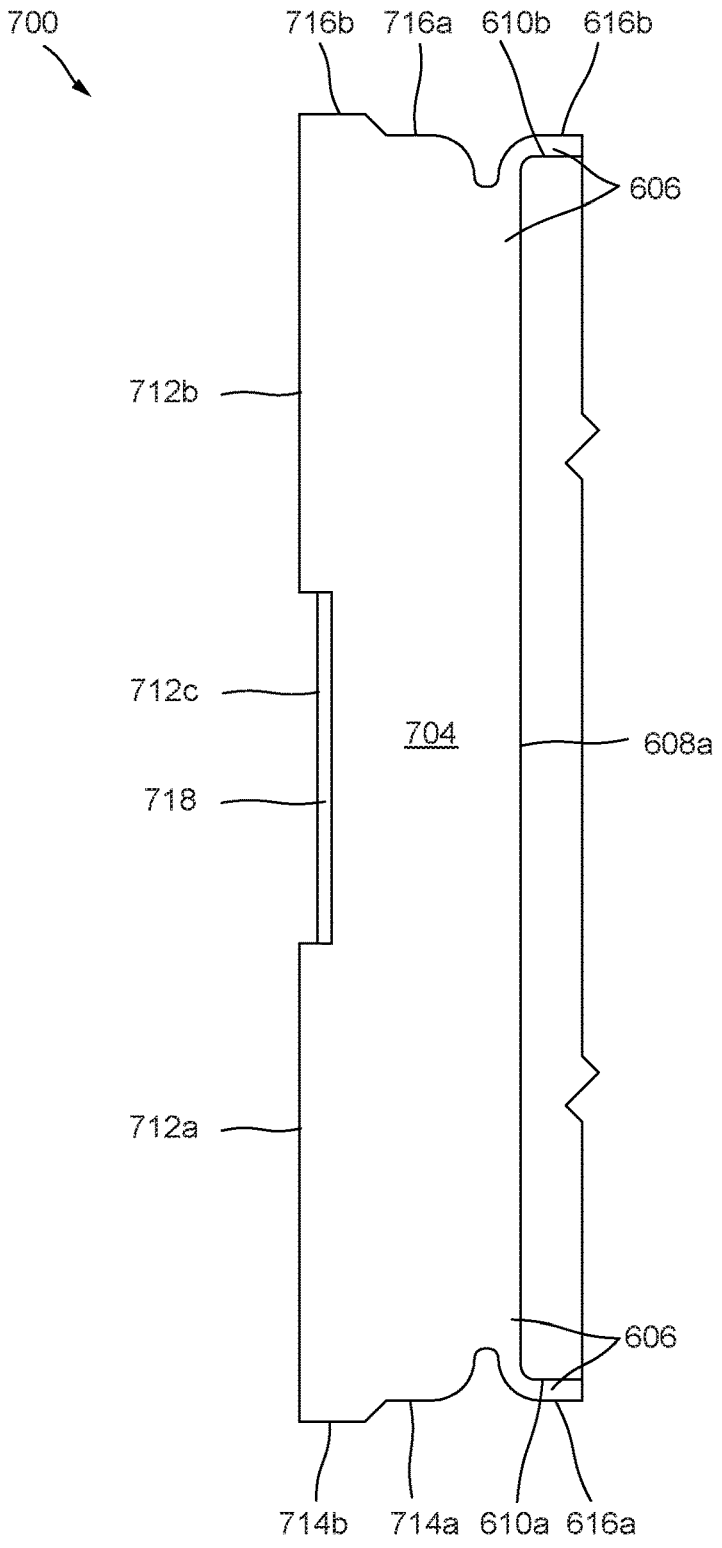
FIG. 38 is a top view of a first lid of the case of FIG. 28.
Figure 39:
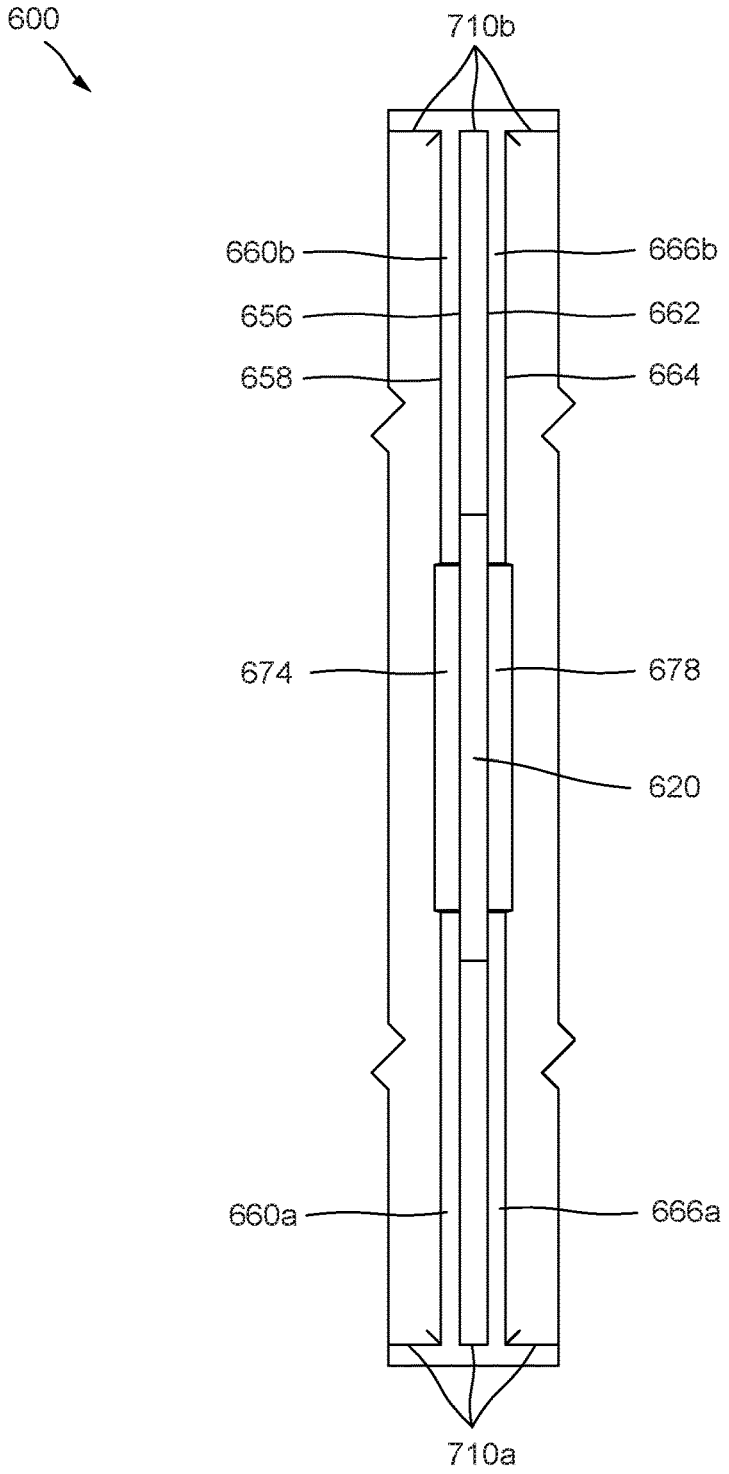
FIG. 39 is a top view of a portion of a body and divider of the case of FIG. 28.
Figure 40:
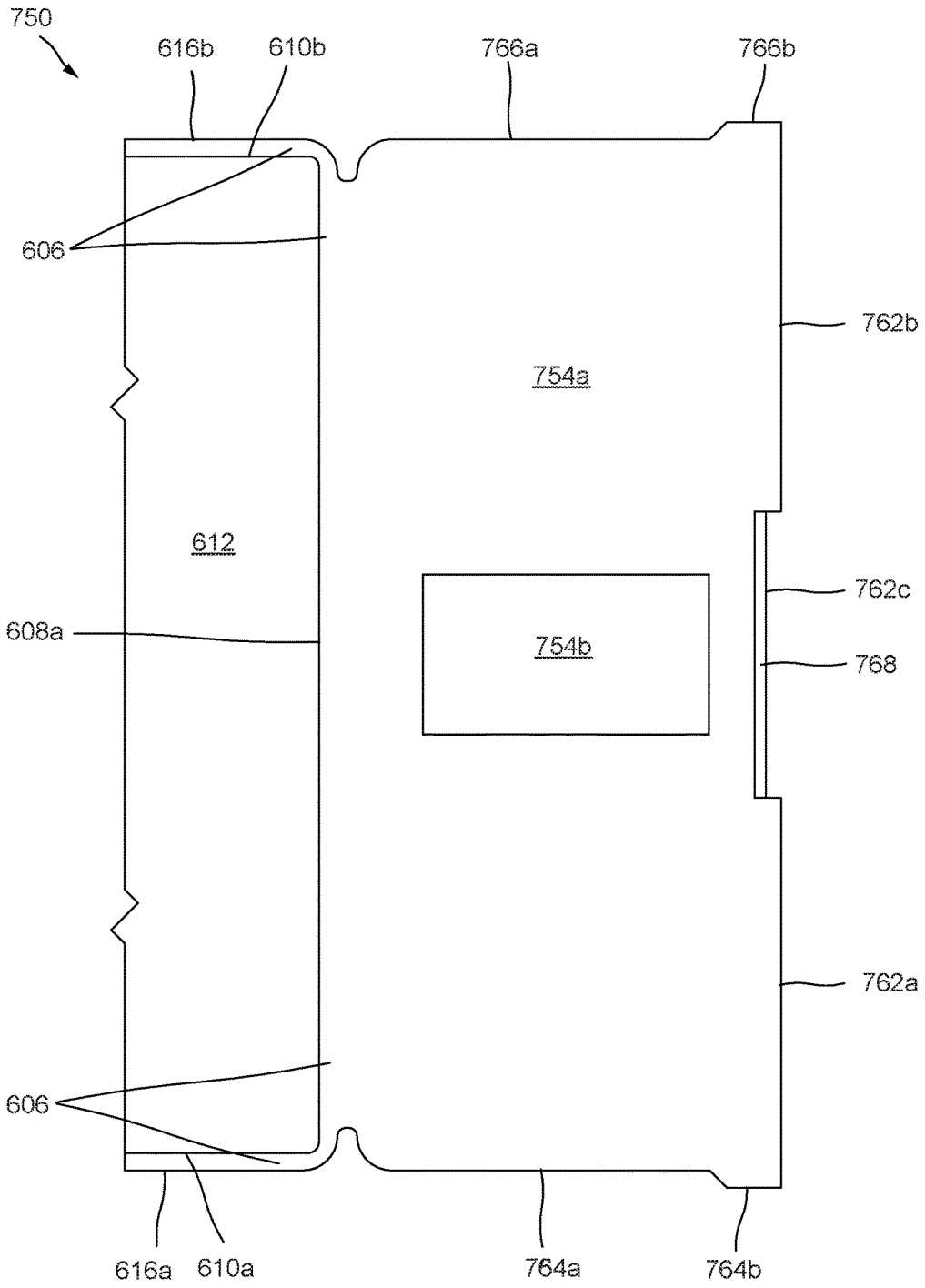
FIG. 40 is a top view of a second lid of the case of FIG. 28.
Figure 41:
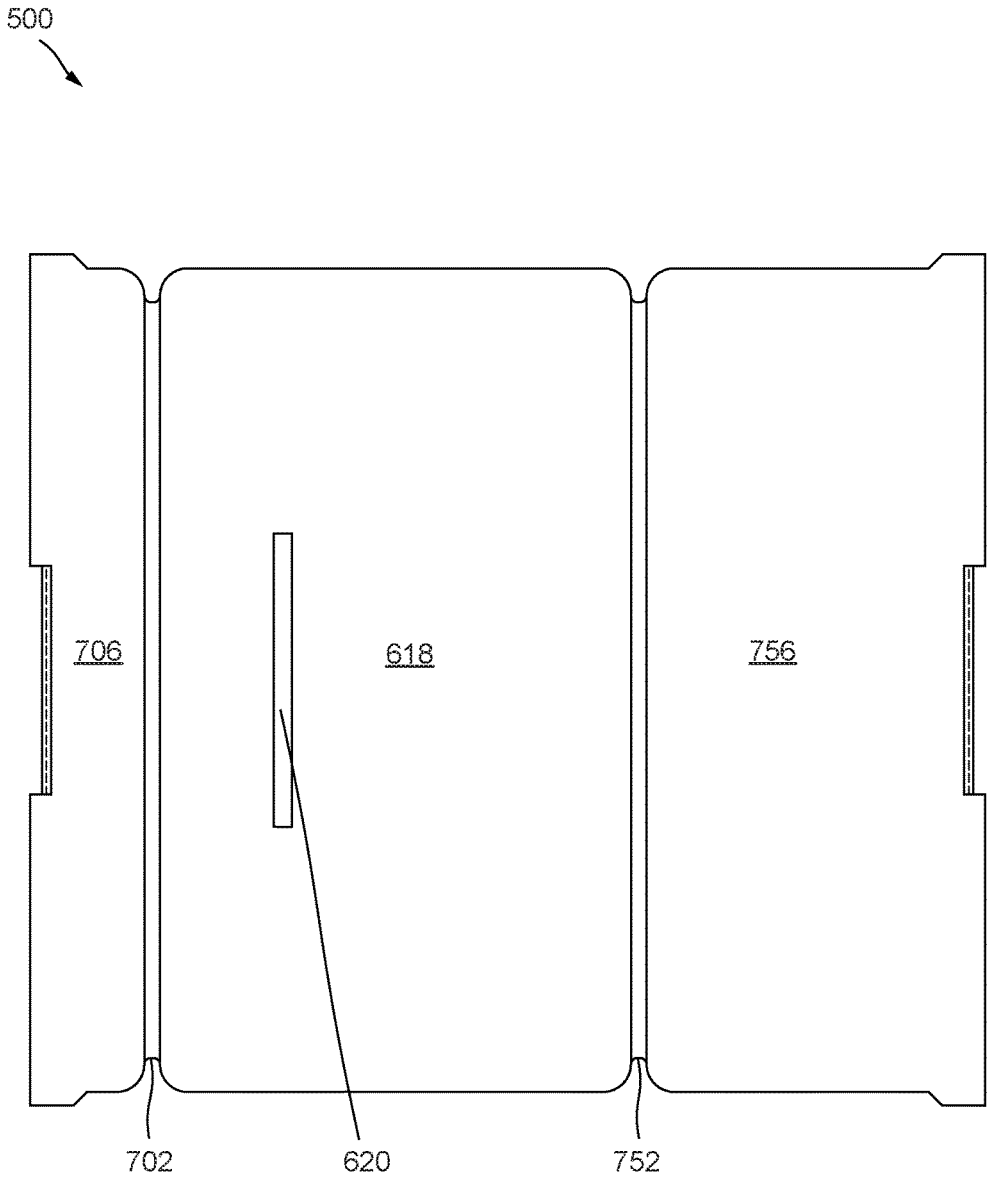
FIG. 41 is a bottom view of the case of FIG. 28 with first and second lids open.
Figure 42:
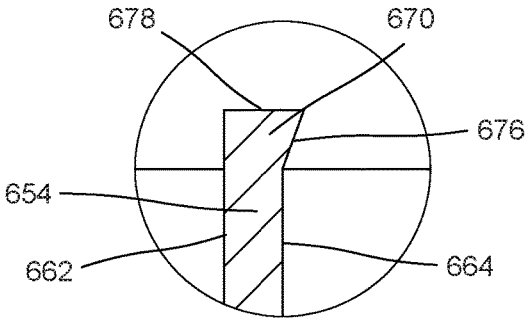
FIG. 42 is a side view of an overhang of the case of FIG. 28.
Figure 43:
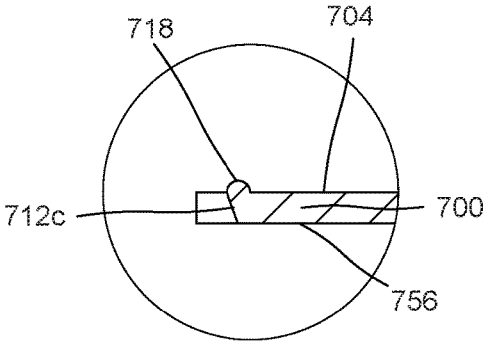
FIG. 43 is a side view of a first lid of the case of FIG. 28.
Figure 44:
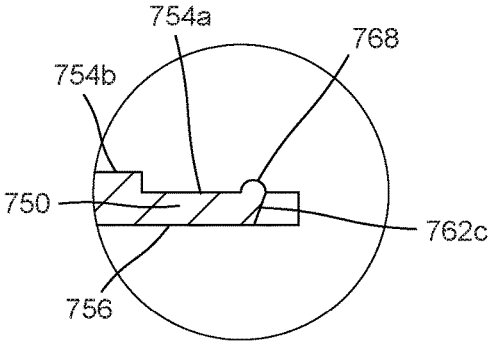
FIG. 44 is a side view of a second lid of the case of FIG. 28.
Figure 45:
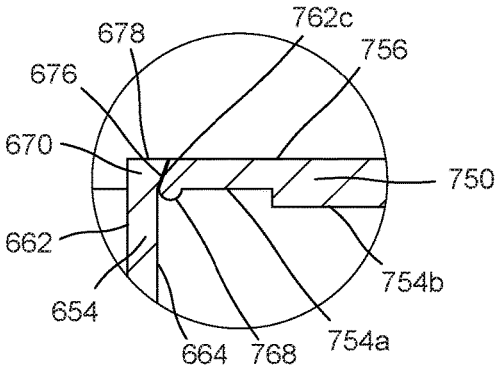
FIG. 45 is a side view of an overhang and a second lid of the case of FIG. 28.
Figure 46:
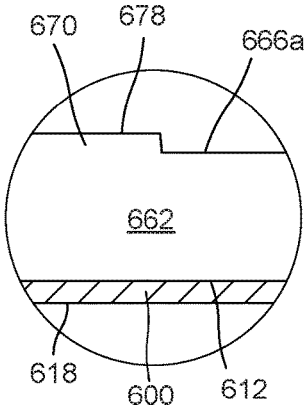
FIG. 46 is a side view of an overhang of the case of FIG. 28.

FIGS. 27 through 46 show a case 500 for tobacco products in accordance with a second embodiment of the present invention. The case 500 of the second embodiment includes a body 600, a divider 650, first and second lids 700 and 750, and first and second hinges 702 and 752 that are the similar to the body 200, divider 250, and first and second lids 300 and 350 of the case 100 of the first embodiment, with the exception of the features described herein. Notably, the case 500 of the second embodiment excludes the first and second arms 320 and 370 of the first embodiment, relying on a snap fit mechanism to detachably couple the first and second lids 700 and 750 to the divider 650, rather than using the interference fit mechanism provided by the first and second arms 320 and 370 of the first embodiment.

The body 600 of the second embodiment may include an inner surface 602, an outer surface 604, and a lip 606. The inner surface 602 may include first and second planar lateral portions 608*a* and 608*b*, planar anterior and posterior portions 610*a* and 610*b*, and a planar lower portion 612. The outer surface 604 may similarly include first and second planar lateral portions 614*a* and 614*b*, planar anterior and posterior portions 616*a* and 616*b*, and a planar lower portion 618. Preferably, the body 600 of the second embodiment is configured similarly to the body 200 of the first embodiment, except that an aperture 620 may be formed through a lower portion of the body 600 defined by lower portions 612 and 618 of inner and outer surfaces 602 and 604. between walls 652 and 654 of a divider 650. The aperture 520, which is rectangular in the configuration shown, may be useful for molding purposes, allowing a core (not shown) to be passed through the body 200 between the first and second walls 602 and 604 of the divider 600.

The divider 650 of the second embodiment may include a first wall 652 and a second wall 654. The first wall may have a first surface 656, a second surface 658, and a lip 660. Similarly, the second wall 654 may include a first surface 662, a second surface 664, and a lip 666. The divider 650 of the second embodiment is similar to the divider 250 of the first embodiment, except that the divider 650 of the second embodiment excludes the recesses formed in the first and second walls 252 and 254 of the divider 250 of the first embodiment. Instead, the divider 600 includes a first overhang 672 that is preferably formed on a first projection 668 extending upward between anterior and posterior portions 660*a* and 660*b* of the lip 660 of the first wall 652, and a second overhang 676 that is preferably formed on a second projection 670 extending upward between anterior and posterior portions 666*a* and 666*b* of the lip 666 of the second wall 654.

The first overhang 672 is configured to engage the distal portion 712 of the rim 708 of the first lid 700 when the first lid 700 is in a closed position, thereby detachably coupling the first lid 700 to the divider 650 by achieving a snap fit between the first overhang 672 and the first lid 700. The first overhang 672 disengages the distal portion 712 of the rim 708 of the first lid 700 when the first lid 700 is in an open position. Preferably, the first overhang 672 is a first planar retraction surface that extends between an upper edge of the second surface 658 of the first wall 652 and a projecting edge of a planar upper surface 674 of the first projection 668. In this configuration, the first planar refraction surface intersects the second surface 658 of the first wall 652 at a first obtuse refraction angle.

Likewise, the second overhang 676 is configured to engage the distal portion 762 of the rim 758 of the second lid 750 when the second lid 750 is in a closed position, thereby detachably coupling the second lid 750 to the divider 650 by achieving a snap fit between the second overhang 676 and the second lid 750. The second overhang 676 disengages the distal portion 762 of the rim 758 of the second lid 750 when the second lid 750 is in an open position. Preferably, the second overhang 676 is a second planar retraction surface that extends between an upper edge of the second surface 664 of the second wall 654 and a projecting edge of a planar upper surface 678 of the second projection 670. In this configuration, the second planar refraction surface intersects the second surface 664 of the second wall 654 at a second obtuse refraction angle.

The first lid 700 of the second embodiment may be pivotally coupled to the body 600 by a first hinge 702, and may include an inner surface 704, an outer surface 706, and a rim 708. Preferably, the inner and outer surfaces 704 and 706 of the first lid 700 are both planar. Thus, the outer surface 706 of the first lid 700 of the second embodiment may exclude the elevated portion 306*b* of the outer surface 306 first lid 300 of the first embodiment.

The rim 708 of the first lid 700 may include a proximal portion 710, a distal portion 712, an anterior portion 714, and a posterior portion 716. Preferably, the anterior portion 714 of the rim 708 of the first lid 700 includes a principal portion 714*a* that is coplanar with the outer surface 704 of the body 700. The anterior portion 714 of the rim 708 of the first lid 700 may also include at its distal end a projecting portion 714*b* that extends outward from the principal portion 714*a* so as to overhang the outer surface 604 of the body 600. Similarly, the posterior portion 716 of the rim 708 of the first lid 700 preferably includes a principal portion 716*a* that is coplanar with the outer surface 604 of the body 600. The posterior portion 716 of the rim 708 of the first lid 700 may also include at its distal end a projecting portion 716*b* that extends outward from the principal portion 716*a* so as to overhang the outer surface 604 of the body 600.

A recess may be formed in the first lid 700. In this configuration, the distal portion 712 of the rim 708 includes anterior and posterior portions 712*a* and 712*b*, and an intermediate portion 712*c*. Preferably, the proximal portion 710 and the anterior and posterior portions 712*a* and 712*b* of the distal portion 712 of the rim 708 are thin surfaces, and the anterior and posterior portions 712*a* and 712*b* of the rim 708 are coplanar with each other and parallel to the proximal portion 710 of the rim 708. The intermediate portion 712*c* extends laterally inward between the anterior and posterior portions 712*a* and 712*b* of the distal portion 712 of the rim 708 and delimits the recess formed in the first lid 700. Preferably, the intermediate portion 712*c* of the distal portion 712 of the rim 708 includes a chamfer or a bevel that is configured to engage the first planar retraction surface of the first projection 668 extending upward from the first wall 652 of the divider 750. In this configuration, the planar upper surface 674 of the first projection 668 is coplanar with the outer surface 706 of the first lid 700 when the first lid 700 is in the closed position.

A semi-cylindrical projection 718 may extend outward from a distal end of the inner surface 704 of the first lid 700, along the bevel or chamfer of the intermediate portion 712*c* of the distal portion 712 of the rim 708. Preferably, the semi-cylindrical projection 718 of the first lid 700 is configured to press against the projecting edge of the first projection 688 when the first lid 700 is moved from the open position to the closed position, causing the first wall 652 of the divider 650 to deflect, thereby allowing the bevel or chamfer of the intermediate portion 712*c* of the distal portion 712 of the rim 708 to snap in place against the first planar refraction surface of the first projection 668. The shape and thickness of the first wall 652, the shape and size of the first projection 668 and the bevel or chamfer of the intermediate portion 712*c* of the distal portion 712 of the rim 708, and the materials used to make the case 500 can be varied to adjust the amount of force required to open and close the first lid 700.

Similarly, the second lid 750 of the second embodiment may be pivotally coupled to the body 600 by a second hinge 752, and may include an inner surface 754, an outer surface 756, and a rim 758. The inner surface 754 of the second lid 750 may include a peripheral portion 754*a*, and a central portion 754*b* that extends outward from the peripheral portion 754. Preferably, the peripheral and central portions 754*a* and 754*b* of the inner surface 754 of the first lid 750 are planar and parallel to each other. In this configuration, the peripheral portion 754*a* of the second lid 750 contacts the lip 606 of the body 600, and the central portion 754*b* may press against any tobacco products stored in the second compartment to help prevent them from shifting when the second lid 750 is in the closed position. Preferably, the outer surface 756 of the second lid 750 is planar. Thus, the outer surface 756 of the second lid 700 of the second embodiment may exclude the elevated portion 356*b* of the outer surface 356 of the second lid 350 of the first embodiment.

The rim 758 of the second lid 750 may include a proximal portion 760, a distal portion 762, an anterior portion 764, and a posterior portion 766. Preferably, the anterior portion 764 of the rim 758 of the second lid 750 includes a principal portion 764*a* that is coplanar with the outer surface 604 of the body 600. The anterior portion 764 of the rim 758 of the second lid 750 may also include at its distal end a projecting portion 764*b* that extends outward from the principal portion 764*a* so as to overhang the outer surface 604 of the body 600. Similarly, the posterior portion 766 of the rim 758 of the second lid 750 preferably includes a principal portion 766*a* that is coplanar with the outer surface 604 of the body 600. The posterior portion 766 of the rim 758 of the second lid 750 may also include at its distal end a projecting portion 766*b* that extends outward from the principal portion 766*a* so as to overhang the outer surface 604 of the body 600.

A recess may be formed in the second lid 750. In this configuration, the distal portion 762 of the rim 758 includes anterior and posterior portions 762*a* and 762*b*, and an intermediate portion 762*c*. Preferably, the proximal portion 760 and the anterior and posterior portions 762*a* and 762*b* of the distal portion 762 of the rim 758 are thin surfaces, and the anterior and posterior portions 762*a* and 762*b* of the rim 758 are coplanar with each other and parallel to the proximal portion 760 of the rim 758. The intermediate portion 762*c* extends laterally inward between the anterior and posterior portions 762*a* and 762*b* of the distal portion 762 of the rim 758 and delimits the recess formed in the first lid 750.

Preferably, the intermediate portion 762*c* of the distal portion 762 of the rim 758 includes a chamfer or a bevel that is configured to engage the second planar retraction surface of the second projection 670 extending upward from the second wall 654 of the divider 750. In this configuration, the planar upper surface 678 of the second projection 670 is coplanar with the outer surface 756 of the second lid 750 when the second lid 750 is in a closed position.

A semi-cylindrical projection 758 may extend outward from a distal end of the inner surface 754 of the second lid 750, along the bevel or chamfer of the intermediate portion 762*c* of the distal portion 762 of the rim 758. Preferably, the semi-cylindrical projection 768 of the second lid 750 is configured to press against the projecting edge of the second projection 670 when the second lid 700 is moved from the open position to the closed position, causing the second wall 654 of the divider 650 to deflect, thereby allowing the bevel or chamfer of the intermediate portion 762*c* of the distal portion 762 of the rim 758 to snap in place against the second planar refraction surface of the second projection 670. The shape and thickness of the second wall 654, the shape and size of the second projection 670 and the bevel or chamfer of the intermediate portion 762*c* of the distal portion 762 of the rim 758, and the materials used to make the case 500 can be varied to adjust the amount of force required to open and close the second lid 750.

Those skilled in the art will appreciate that the embodiments described herein are illustrative and not restrictive, and that modifications may occur depending upon design requirements without departing from the principles of the invention, the scope of which is defined in the claims.

What is claimed is:

1. A case for storing tobacco products comprising:

a body having a cavity formed therein, said body comprising:

an inner surface defining an interior boundary of said body and delimiting said cavity;

an outer surface defining an exterior boundary of said body; and a lip defining an upper boundary of said body and circumscribing an open upper end of said cavity, said lip of said body being demarcated by upper edges of said inner and outer surfaces of said body;

a divider traversing said cavity and defining a partition between first and second compartments within said cavity;

a first lid comprising:

an inner surface;

an outer surface; and a rim demarcated by peripheral edges of said inner and outer surfaces of said first lid;

means for pivotally coupling said first lid to said body such that said first lid can pivot back and forth from an open position, in which said first compartment is accessible through said lip of said body, to a closed position, in which said first compartment is enclosed by said body, said divider, and said first lid, said inner surface of said first lid contacting said lip of said body when said first lid is in said closed position;

means for detachably securing said first lid to said divider when said first lid is in said closed position;

a second lid comprising:

an inner surface;

an outer surface; and a rim demarcated by peripheral edges of said inner and outer surfaces of said second lid;

means for pivotally coupling said second lid to said body such that said second lid can pivot back and forth from an open position, in which said second compartment is accessible through said lip of said body, to a closed position, in which said second compartment is enclosed by said body, said divider, and said second lid, said inner surface of said second lid contacting said lip of said body when said second lid is in said closed position;

means for detachably securing said second lid to said divider when said second lid is in said closed position; and a metal cap comprising first and second lateral portions, a posterior portion, and a lower portion, said metal cap being affixed within said first compartment such that said first lateral portion, said posterior portion, and said lower portion of said metal cap are coupled to said inner surface of said body, and said second lateral portion of said metal cap is coupled to said divider.

2. The case of claim 1 wherein:

said divider has a slot formed therein, said divider comprising:

a first wall comprising:

a first surface partially delimiting said slot;

a second surface partially delimiting said first compartment; and a lip defining an upper boundary of said first wall, said lip of said first wall being demarcated by upper edges of said first and second surfaces of said first wall; and a second wall comprising:

a first surface partially delimiting said slot;

a second surface partially delimiting said second compartment; and a lip defining an upper boundary of said second wall, said lip of said second wall being demarcated by upper edges of said first and second surfaces of said second wall;

said means for detachably coupling said first lid to said divider comprises a first arm extending outward from said inner surface of said first lid, said first arm comprising first and second surfaces defining opposite sides of said first arm;

said means for detachably coupling said second lid to said divider comprises a second arm extending outward from said inner surface of said second lid, said second arm comprising first and second surfaces defining opposite sides of said second arm; said case is configured such that:

said first arm is received within said slot and said first surface of said first arm is positioned flush against said first surface of said first wall to achieve an interference fit between said first arm and said divider when said first lid is in said closed position, and said first arm vacates said slot when said first lid is in said open position; and said second arm is received within said slot and said first surface of said second arm is positioned flush against said first surface of said second wall to achieve an interference fit between said second arm and said divider when said second lid is in said closed position, and said second arm vacates said slot when said second lid is in said open position.

3. The case of claim 2 wherein:

said first and second surfaces of said first and second walls each comprise a planar lateral portion, said planar lateral portions of said first and second surfaces of said first and second walls being parallel to one another; and said inner surface of said body comprises:

first and second planar lateral portions that are parallel to each other and to said planar lateral portions of said first and second surfaces of said first and second walls, said first planar lateral portion of said inner surface of said body partially delimiting said first compartment, and said second planar lateral portion of said inner surface of said body partially delimiting said second compartment;

planar anterior and posterior portions that are parallel to each other, and that are perpendicular to said first and second planar lateral portions of said inner surface of said body and to said planar lateral portions of said first and second surfaces of said first and second walls, anterior ends of said first and second walls being coupled to said planar anterior portion of said inner surface of said body, and posterior ends of said first and second walls being coupled to said planar posterior portion of said inner surface of said body; and a planar lower portion that is perpendicular to said first and second planar lateral portions, said planar anterior portion, and said planar posterior portion of said inner surface of said body, and to said planar lateral portions of said first and second surfaces of said first and second walls, lower ends of said first and second walls being coupled to said planar lower portion of said body.

4. The case of claim 3 wherein:

said first wall has a recess formed therein, said lip of said first wall comprising:

anterior and posterior portions that are contiguous and coplanar with said lip of said body, said inner surface of said first lid contacting said anterior and posterior portions of said lip of said first wall when said first lid is in said closed position; and an intermediate portion extending downward between said anterior and posterior portions of said lip of said first wall and delimiting said recess formed in said first wall; and said second wall has a recess formed therein, said lip of said second wall comprising:

anterior and posterior portions that are contiguous and coplanar with said lip of said body, said inner surface of said second lid contacting said anterior and posterior portions of said lip of said second wall when said second lid is in said closed position; and an intermediate portion extending downward between said anterior and posterior portions of said lip of said second wall and delimiting said recess formed in said second wall.

5. The case of claim 2 wherein:

said rim of said first lid comprises proximal and distal portions that are parallel to each other, said case being configured such that said distal portion of said rim of said first lid rotates around said proximal portion of said rim of said first lid when said first lid pivots back and forth from said open position to said closed position;

said rim of said second lid comprises proximal and distal portions that are parallel to each other, said case being configured such that said distal portion of said rim of said second lid rotates around said proximal portion of said rim of said second lid when said second lid pivots back and forth from said open position to said closed position;

said inner surfaces of said first and second lids each comprise a planar portion, a proximal end of said first arm being coupled to said planar portion of said inner surface of said first lid, and a proximal end of said second arm being coupled to said planar portion of said inner surface of said second lid;

said first and second surfaces of said first arm each comprise a planar portion, said planar portions of said first and second surfaces of said first arm being parallel to each other and to said proximal and distal portions of said rim of said first lid, and said planar portions of said first and second surfaces of said first arm being perpendicular to said planar portion of said inner surface of said first lid; and said first and second surfaces of said second arm each comprise a planar portion, said planar portions of said first and second surfaces of said second arm being parallel to each other and to said proximal and distal portions of said rim of said second lid, and said planar portions of said first and second surfaces of said second arm being perpendicular to said planar portion of said inner surface of said second lid.

6. The case of claim 5 wherein:

distal edges of said planar portions of said first and second surfaces of said first arm are parallel to said planar portion of said inner surface of said first lid, and are coupled to each other by a bevel or a chamfer; and distal edges of said planar portions of said first and second surfaces of said second arm are parallel to said planar portion of said inner surface of said second lid, and are coupled to each other by a bevel or a chamfer.

7. The case of claim 1 wherein:

said rim of said first lid comprises proximal and distal portions, said case being configured such that said distal portion of said rim of said first lid rotates around said proximal portion of said rim of said first lid when said first lid pivots back and forth from said open position to said closed position;

said rim of said second lid comprises proximal and distal portions, said case being configured such that said distal portion of said rim of said second lid rotates around said proximal portion of said rim of said second lid when said second lid pivots back and forth from said open position to said closed position;

said means for detachably coupling said first lid to said divider comprises a first overhang formed on said divider, and said means for detachably coupling said second lid to said divider comprises a second overhang formed on said divider, said case being configured such that:

said first overhang engages said distal portion of said rim of said first lid to achieve a snap fit between said first lid and said divider when said first lid is in said closed position, and said first overhang disengages said distal portion of said rim of said first lid when said first lid is in said open position; and said second overhang engages said distal portion of said rim of said second lid to achieve a snap fit between said second lid and said divider when said second lid is in said closed position, and said second overhang disengages said distal portion of said rim of said second lid when said second lid is in said open position.

8. The case of claim 7 wherein:

said divider has a slot formed therein, said divider comprising:

a first wall comprising:

a first surface partially delimiting said slot;

a second surface partially delimiting said first compartment; and a lip defining an upper boundary of said first wall, said lip of said first wall comprising anterior and posterior portions that are demarcated by upper edges of said first and second surfaces of said first wall and are contiguous and coplanar with said lip of said body, said inner surface of said first lid contacting said anterior and posterior portions of said lip of said first wall when said first lid is in said closed position; and a second wall comprising:

a first surface partially delimiting said slot;

a second surface partially delimiting said second compartment; and a lip defining an upper boundary of said second wall, said lip of said second wall comprising anterior and posterior portions that are demarcated by upper edges of said first and second surfaces of said second wall and are contiguous and coplanar with said lip of said body, said inner surface of said second lid contacting said anterior and posterior portions of said lip of said second wall when said second lid is in said closed position;

said means for detachably coupling said first lid to said divider further comprises a first projection extending upward from said first wall between said anterior and posterior portions of said lip of said first wall; and said means for detachably coupling said second lid to said divider further comprises a second projection extending upward from said second wall between said anterior and posterior portions of said lip of said second wall.

9. The case of claim 8 wherein:

said first and second surfaces of said first and second walls each comprise a planar lateral portion, said planar lateral portions of said first and second surfaces of said first and second walls being parallel to one another;

said inner surface of said body comprises:

first and second planar lateral portions that are parallel to each other and to said planar lateral portions of said first and second surfaces of said first and second walls, said first planar lateral portion of said inner surface of said body partially delimiting said first compartment, and said second planar lateral portion of said inner surface of said body partially delimiting said second compartment;

planar anterior and posterior portions that are parallel to each other, and that are perpendicular to said first and second planar lateral portions of said inner surface of said body and to said planar lateral portions of said first and second surfaces of said first and second walls, anterior ends of said first and second walls being coupled to said planar anterior portion of said inner surface of said body, and posterior ends of said first and second walls being coupled to said planar posterior portion of said inner surface of said body; and a planar lower portion that is perpendicular to said first and second planar lateral portions, said planar anterior portion, and said planar posterior portion of said inner surface of said body, and to said planar lateral portions of said first and second surfaces of said first and second walls, lower ends of said first and second walls being coupled to said planar lower portion of said body;

said first and second projections each comprise a planar upper surface;

said first overhang comprises a first planar retraction surface extending between said upper edge of said second surface of said first wall and a projecting edge of said planar upper surface of said first projection, said first planar retraction surface and said planar lateral portion of said second surface of said first wall intersecting at a first obtuse refraction angle; and said second overhang comprises a second planar retraction surface extending between said upper edge of said second surface of said second wall and a projecting edge of said planar upper surface of said second projection, said second planar retraction surface and said planar lateral portion of said second surface of said second wall intersecting at a second obtuse refraction angle.

10. The case of claim 9 wherein:

said first lid has a recess formed therein, said distal portion of said rim of said first lid comprising:

anterior and posterior portions that are coplanar with each other, and that are parallel with said proximal portion of said rim of said first lid; and an intermediate portion extending laterally inward between said anterior and posterior portions of said distal portion of said rim of said first lid and delimiting said recess formed in said first lid, said intermediate portion of said distal portion of said rim of said first lid comprising a bevel or chamfer;

said second lid has a recess formed therein, said distal portion of said rim of said second lid comprising:

anterior and posterior portions that are coplanar with each other, and that are parallel with said proximal portion of said rim of said second lid; and an intermediate portion extending laterally inward between said anterior and posterior portions of said distal portion of said rim of said second lid and delimiting said recess formed in said second lid, said intermediate portion of said distal portion of said rim of said second lid comprising a bevel or chamfer;

said case is configured such that:

said planar upper surface of said first projection is coplanar with said outer surface of said first lid and said bevel or chamfer of said rim of said first lid is positioned flush against said first planar retraction surface when said first lid is in said closed position; and said planar upper surface of said second projection is coplanar with said outer surface of said second lid and said bevel or chamfer of said rim of said second lid is positioned flush against said second planar retraction surface when said second lid is in said closed position.

11. The case of claim 10 wherein:

said first lid further comprises a semi-cylindrical projection extending outward from a distal end of said inner surface of said first lid along said bevel or chamfer of said first lid; and said second lid further comprises a semi-cylindrical projection extending outward from a distal end of said inner surface of said second lid along said bevel or chamfer of said second lid.

12. The case of claim 1 wherein said divider is offset from a centerline of said cavity, such that said first compartment is smaller than said second compartment, and such that said first lid is smaller than the second lid.

13. The case of claim 1 wherein said outer surface of said body comprises: first and second planar lateral portions that are parallel to each other;

planar anterior and posterior portions that are parallel to each other, and that are perpendicular to said first and second planar lateral portions of said outer surface of said body; and a planar lower portion that is perpendicular to said first and second planar lateral portions, said planar anterior portion, and said planar posterior portion of said outer surface of said body.

14. The case of claim 13 wherein:

said rim of said first lid comprises proximal and distal portions, said case being configured such that said distal portion of said rim of said first lid rotates around said proximal portion of said rim of said first lid when said first lid pivots back and forth from said open position to said closed position;

said rim of said second lid comprises proximal and distal portions, said case being configured such that said distal portion of said rim of said second lid rotates around said proximal portion of said rim of said second lid when said second lid pivots back and forth from said open position to said closed position;

said means for pivotally coupling said first lid to said body comprises a first living hinge coupling said proximal portion of said rim of said first lid to an upper end of said first planar lateral portion of said outer surface of said body; and said means for pivotally coupling said second lid to said body comprises a second living hinge coupling said proximal portion of said rim of said second lid to an upper end of said second planar lateral portion of said outer surface of said body.

15. The case of claim 1 further comprising a metal lid coupled to said inner surface of said first lid so as to face said lower portion of said metal cap when said first lid is in said closed position.

16. The case of claim 1 wherein:

said rim of said first lid comprises:

an anterior portion comprising a principal portion that is coplanar with said outer surface of said body, and a projecting portion formed at a distal end of said anterior portion of said rim of said first lid, said projecting portion of said anterior portion of said rim of said first lid extending outward from said principal portion of said anterior portion of said rim of said first lid so as to overhang said outer surface of said body; and a posterior portion comprising a principal portion that is coplanar with said outer surface of said body, and a projecting portion formed at a distal end of said posterior portion of said rim of said first lid, said projecting portion of said posterior portion of said first lid extending outward from said principal portion of said posterior portion of said rim of said first lid so as to overhang said outer surface of said body; and said rim of said second lid comprises:

an anterior portion comprising a principal portion that is coplanar with said outer surface of said body, and a projecting portion formed at a distal end of said anterior portion of said rim of said second lid, said projecting portion of said anterior portion of said rim of said second lid extending outward from said principal portion of said anterior portion of said rim of said second lid so as to overhang said outer surface of said body; and a posterior portion comprising a principal portion that is coplanar with said outer surface of said body, and a projecting portion formed at a distal end of said posterior portion of said rim of said second lid, said projecting portion of said posterior portion of said second lid extending outward from said principal portion of said posterior portion of said rim of said second lid so as to overhang said outer surface of said body.

17. The case of claim 1 wherein:

said rim of said first lid comprises proximal and distal portions, said case being configured such that said distal portion of said rim of said first lid rotates around said proximal portion of said rim of said first lid when said first lid pivots back and forth from said open position to said closed position;

said rim of said second lid comprises proximal and distal portions, said case being configured such that said distal portion of said rim of said second lid rotates around said proximal portion of said rim of said second lid when said second lid pivots back and forth from said open position to said closed position;

said outer surface of said first lid comprises:

a principal portion;

an elevated portion formed at a distal end of said outer surface of said first lid, said elevated portion extending upward from said principal portion of said outer surface of said first lid; and said outer surface of said second lid comprises:

a principal portion;

an elevated portion formed at a distal end of said outer surface of said second lid, said elevated portion extending upward from said principal portion of said outer surface of said second lid.

18. The case of claim 17 wherein:

said elevated portion of said outer surface of said first lid has a different texture than said principal portion of said outer surface of said first lid; and said elevated portion of said outer surface of said second lid has a different texture than said principal portion of said outer surface of said second lid.

19. The case of claim 17 wherein:

said elevated portion of said outer surface of said first lid has a different color than said principal portion of said outer surface of said first lid; and said elevated portion of said outer surface of said second lid has a different color than said principal portion of said outer surface of said second lid.

20. The case of claim 1 wherein:

said inner surface of said second lid comprises:

a planar peripheral portion that contacts said lip of said body when said lid is in said closed position; and a planar central portion that projects outward from, and is parallel to, said peripheral portion of said inner surface of said first lid.

* * * * *